US011390405B2

(12) United States Patent
Spindler et al.

(10) Patent No.: US 11,390,405 B2
(45) Date of Patent: Jul. 19, 2022

(54) METHOD AND APPARATUS FOR PRODUCING A MULTIPACK WITH SEVERAL BEVERAGE CONTAINERS

(71) Applicant: Krones Aktiengesellschaft, Neutraubling (DE)

(72) Inventors: Herbert Spindler, Niedermoosen (DE); Markus Gabler, Rohrdorf-Thansau (DE); Thomas Stadler, Kolbermoor (DE); Johann Luber, Bad Feilnbach (DE); Tobias Gut, Unterhaching (DE)

(73) Assignee: KRONES Aktiengesellschaft, Neutraubling (DE)

( * ) Notice: Subject to any disclaimer, the term of this patent is extended or adjusted under 35 U.S.C. 154(b) by 187 days.

(21) Appl. No.: 16/875,787

(22) Filed: May 15, 2020

(65) Prior Publication Data

US 2020/0361645 A1 Nov. 19, 2020

(51) Int. Cl.
*B65B 17/02* (2006.01)
*B65B 35/30* (2006.01)
(Continued)

(52) U.S. Cl.
CPC ..... *B65B 17/025* (2013.01); *B65B 35/30* (2013.01); *B65B 41/02* (2013.01); *B65D 71/42* (2013.01)

(58) Field of Classification Search
CPC ..... B65B 35/30; B65B 41/02; B65B 17/025; B65D 71/42; B65D 71/50
See application file for complete search history.

(56) References Cited

U.S. PATENT DOCUMENTS 2,936,070 A 5/1960 Jules
3,032,944 A * 5/1962 Hull ..... B65B 17/025 53/543
(Continued)

FOREIGN PATENT DOCUMENTS

DE 3046423 A1 7/1982
DE 102013113754 A1 6/2015
(Continued)

OTHER PUBLICATIONS

Patent Application No. 10 2019 113 176.6 filed May 17, 2019 in Germany—German Search Report dated Feb. 12, 2020.
(Continued)

*Primary Examiner* — Andrew M Tecco
(74) *Attorney, Agent, or Firm* — Simmons Perrine Moyer Bergman PLC

(57) ABSTRACT

An apparatus (1) for assembling several beverage containers (2) into a multipack (4) is disclosed. The apparatus (1) comprises a horizontal conveying device (5) for moving groupings (3), each grouping (3) comprising several beverage containers (2). The apparatus (1) also comprises at least one working device (25) that applies packaging blanks (41) to the groupings (3). The beverage containers (2) of a grouping (3) pass through openings in the packaging blank (41) and are held together by the packaging blank (41). The apparatus (1) furthermore comprises at least one handling apparatus (15) which places the beverage containers (2) on the horizontal conveying device (5) such that the beverage containers (2) are in alignment with respect to one another. The alignment of the beverage containers (2) allows the packaging blank (41) to be applied to the beverage containers (2) directly upon their placement on the horizontal conveying device (5).

17 Claims, 14 Drawing Sheets

(51) Int. Cl.
*B65B 41/02* (2006.01)
*B65D 71/42* (2006.01)

(56) References Cited

U.S. PATENT DOCUMENTS

| | | | | | |
|---|---|---|---|---|---|
| 3,137,109 | A | | 6/1964 | Rapata | |
| 3,407,563 | A | | 10/1968 | Dieter et al. | |
| 3,509,684 | A | * | 5/1970 | Scribner | B65B 17/025 53/142 |
| 3,742,677 | A | | 7/1973 | Best | |
| 4,116,331 | A | | 9/1978 | Curry et al. | |
| 4,805,372 | A | * | 2/1989 | Nigrelli | B65B 17/025 53/48.5 |
| 4,817,361 | A | | 4/1989 | Cunningham | |
| 4,953,342 | A | * | 9/1990 | Hynes | B65B 17/025 53/449 |
| 5,088,269 | A | * | 2/1992 | Thelen | B65D 71/504 53/48.2 |
| 5,117,609 | A | | 6/1992 | Seymour et al. | |
| 5,359,830 | A | | 11/1994 | Olson et al. | |
| 8,448,411 | B2 | | 5/2013 | Huber et al. | |
| 2011/0030311 | A1 | * | 2/2011 | Martini | B65H 3/443 53/154 |
| 2017/0190488 | A1 | | 7/2017 | Bates | |
| 2019/0092503 | A1 | | 3/2019 | Daniel et al. | |
| 2019/0119019 | A1 | | 4/2019 | Patton | |

FOREIGN PATENT DOCUMENTS

| | | | |
|---|---|---|---|
| DE | 202018106535 | U1 | 1/2019 |
| WO | 9906280 | A1 | 2/1999 |

OTHER PUBLICATIONS

European International Search Report and Written Opinion dated Jul. 21, 2020.
DE 10 2019 135 254.1 German Search Report dated Aug. 24, 2020.
PCT/EP2020/061559 International Search Report dated Aug. 28, 2020.
European Patent Application—Extended European Search Report dated Sep. 21, 2020.
Extended European Search Report for Divisional Application dated Dec. 23, 2021.
PCT/EP2020/061559 International Preliminary Reports of Patentability dated Dec. 2, 2021.
PCT/EP2020/061561 International Preliminary Reports of Patentability dated Dec. 2, 2021.
German Application No. DE 10 2019 128 874.6—German Search Report dated Aug. 12, 2020.

* cited by examiner

METHOD AND APPARATUS FOR PRODUCING A MULTIPACK WITH SEVERAL BEVERAGE CONTAINERS

CLAIM OF PRIORITY

The present application claims priority to German Application DE 10 2019 135 254.1, filed Dec. 19, 2019, German Application DE 10 2019 128 874.6, filed Oct. 25, 2019, and German Application DE 10 2019 113 176.6, filed May 17, 2019, which are incorporated by reference.

FIELD OF THE INVENTION

The present invention concerns a method and an apparatus for producing a multipack comprising a plurality of beverage containers.

BACKGROUND OF THE INVENTION

For the packaging of beverage containers, the beverage containers or bottles can be grouped on horizontal conveying devices and combined into groupings via a packaging material, each grouping comprising a defined number of containers. Well-known examples of such packaging material are strappings, which strappings are applied to a group of beverage containers and which hold the beverage containers of a respective group together. Also known are packaging materials, which consist of thermoplastic material and are shrunk onto a group of articles. Such packaging materials, which are also known as shrink film, are applied to the respective group of articles before being exposed to temperature and thereby shrinking onto the respective group of articles.

Since in practice the consumption of packaging material should be kept as low as possible, packs are also known, in which several beverage containers are held together by a flat packaging blank, which packaging blank is designed with several openings. Through each opening passes the upper part of an assigned beverage container. By such a packaging blank, the beverage containers are held together in a form-fitting and/or force-fitting manner and form a respective multipack. Multipacks of this type are known, for example, to comprise four, six or eight beverage containers.

A multipack, in which the beverage containers are held together by such a packaging blank, is disclosed, for example, in document EP 0 456 357 A1. During production of the multipack disclosed in the EP application, beverage containers are divided into several rows via guide rails. Furthermore, a retaining element is placed in contact with a foremost located beverage container of a respective grouping, and another retaining element is arranged in contact to a beverage container, which beverage container is located at the back of the respective grouping. The beverage containers of a respective grouping are brought into a defined alignment with respect to one another via the guiding rails and the retaining elements, so that a packaging blank can subsequently be placed on the beverage containers via its several openings. Due to the necessary alignment of the beverage containers by guiding rails and retaining elements, it is possible that the beverage containers are unintentionally damaged due to the surface contact with the guiding rails and retaining elements or that the visual appearance of the beverage containers is unintentionally impaired by scratches or deformation due to the surface contact with the guiding rails and retaining elements. Furthermore, the apparatus for producing such multipacks according to the EP application has a complex structure.

For this reason, one task of the invention can be seen as being to provide a generic apparatus and a generic method, with which apparatus and method, the risk of unintentional damage or unintentional impairment of the optical appearance of beverage containers can at least be reduced. Furthermore, one task of the invention can be seen in providing a generic apparatus, which is characterized by a simplified construction. In addition, a task can be seen in providing a method, which can be implemented with reduced constructional effort.

The above task is solved by a method and an apparatus, which include the features in the independent claims. Further advantageous embodiments are described in the dependent claims.

SUMMARY OF THE INVENTION

The invention relates to a method for producing a multipack comprising several beverage containers. A multipack produced by the method can, for example, comprise exactly four, exactly six or exactly eight beverage containers.

One step of the method involves aligning several beverage containers intended for a respective multipack with respect to one another, so that a packaging blank can subsequently be applied to the aligned beverage containers. The aligned beverage containers provided for a respective multipack can form a respective grouping, to which grouping a packaging blank is subsequently applied, so that the packaging blank holds the beverage containers of a respective grouping together in a form-fitting and/or force-fitting manner. In particular, a respective lateral surface area of a respective aligned beverage container of a respective grouping can be in contact or surface contact with a lateral surface area of at least one further aligned beverage container of the respective grouping.

Furthermore, a packaging blank is applied to the several aligned beverage containers, which beverage containers are intended for a respective multipack, whereby the aligned beverage containers of the respective grouping pass through openings of the packaging blank and are subsequently held together by the packaging blank.

A respective packaging blank can thus comprise two opposite broadside surfaces and be interspersed with several openings. In particular, a respective packaging blank may consist of plastic material or cellulose-containing material.

It is provided that several groupings with several beverage containers each are placed or deposited on a horizontal conveying device via at least one handling apparatus in such a way, that the several beverage containers of a respective grouping are in an alignment with respect to one another in order to receive a respective packaging blank, which packaging blank is applied immediately upon placement of the beverage containers on the horizontal conveying device. It is conceivable hereby, that at least approximately simultaneously a plurality of groupings, each grouping comprising a plurality of beverage containers, are placed or deposited on the horizontal conveying device via at least one handling apparatus in such a manner, that the plurality of beverage containers of a respective grouping are aligned with respect to one another for the immediate application of a respective packaging blank to the groupings, when they are placed on the horizontal conveying device.

In practice, embodiments have been proven, in which several groupings, each grouping comprising several beverage containers, are set down or deposited on a horizontal conveying device spaced apart from one another or at a distance from one another by at least one handling apparatus in such a way, that the several beverage containers of a respective grouping are aligned with respect to one another for the subsequent application of a respective packaging blank, which application takes place immediately upon placement of the groupings placed on the horizontal conveying device. Alternatively, it can be provided, that a plurality of groupings, each comprising a plurality of beverage containers, are placed on a horizontal conveying device without a spacing between the groupings by at least one handling apparatus, wherein the plurality of beverage containers of a respective grouping are aligned with respect to one another for the immediate application of a respective packaging blank, which application takes place as soon as the groupings are placed on the horizontal conveying device. It is possible that the groupings are only spaced apart from one another after they have been placed on the horizontal conveying device, wherein the spacing is done in such a manner that the plurality of beverage containers of a respective grouping are still aligned with respect to one another for the application of a respective packaging blank after the respective distancing. In particular, embodiments have proven to be useful, in which groupings, which groupings are located ahead of the other groupings, are accelerated in order to be distanced, thereby maintaining the alignment of their respective beverage containers in relation to the groupings that are lagging behind.

Also, a respective packaging blank is applied to the beverage containers of a respective grouping, which beverage containers are placed on the horizontal conveying device and which beverage containers are aligned with respect to one another.

The method may also provide that the application of a respective packaging blank to the aligned beverage containers, which are intended for a respective multipack, is carried out without the lateral surface areas of the aligned beverage containers bearing against any retaining element and/or guiding element, which retaining element and/or guiding element is designed to maintain alignment. Alternatively or in addition to this, it may be provided, that a movement of the aligned beverage containers, which are intended for a respective multipack, is effected by the horizontal conveying device, wherein the movement takes place without contact of lateral surface areas of the aligned beverage containers with any retaining element and/or guiding element, which retaining element and/or guiding element is normally designed to maintain the alignment. It is therefore possible that during the time of the movement over the horizontal conveying device all beverage containers of a respective grouping exclusively have contact with at least one further beverage container of the grouping and with the horizontal conveying device, and/or that during the time of the movement over the horizontal conveying device all beverage containers of a respective grouping have exclusively only contact to the horizontal conveying device.

It is conceivable, that the beverage containers, which are in an alignment with respect to each other and which are intended for a respective multipack, are moved in time by the horizontal conveying device during the application of the respective packaging blank without interruption and preferably at an at least approximately constant transport speed. Such embodiments are characterized by a high throughput and gentle handling of the beverage containers.

It is also possible, that a respective packaging blank is applied to the aligned beverage containers of a respective grouping via at least one application head, wherein the at least one application head performs a lowering movement for applying packaging blanks to groupings, which lowering movement is oriented in the direction of a respective grouping. The beverage containers of a respective grouping can be moved forward in time during the application of the respective packaging blank, the at least one application head moving along in time with the respective beverage containers of a respective grouping during the application of the respective packaging blank.

It is conceivable, that the at least one application head receives or picks up at least one packaging blank from a stack of several packaging blanks, which stack is positioned laterally beside the horizontal conveying device, then the application head positions the respective at least one packaging blank received from the stack above at least one grouping, which grouping is comprising several beverage containers placed or disposed on the horizontal conveying device in an aligned arrangement, and then the application head executes a lowering movement, which lowering movement is oriented in the direction of the respective grouping. In this manner, the at least one application head can be moved back and forth between the stack and the horizontal conveying device.

It is possible, that the at least one application head, after executing a respective lowering movement, applies several packaging blanks to several different groupings, which several different groupings each comprise several beverage containers, which beverage containers have been placed on the horizontal conveying device and which beverage containers have been aligned with respect to one another. In this way, the at least one application head can, if appropriate, simultaneously hold a plurality of packaging blanks, execute a lowering movement and, after execution of this respective lowering movement, apply the plurality of packaging blanks held by the at least one application head to a plurality of different groupings, which plurality of different groupings each comprise a plurality of beverage containers set down on the horizontal conveying device and aligned with respect to one another. It is possible, that the several groupings, each comprising several beverage containers, are set down on the horizontal conveying device at a distance from one another via the at least one handling apparatus and that the several groupings maintain their distance from one another at least until the respective packaging blank is applied. Thus, the plurality of groupings, each comprising a plurality of beverage containers, can be arranged at a distance from one another on the horizontal conveying device, especially temporarily during the application of a respective packaging blank, or the groupings can be moved at a distance from one another by the horizontal conveying device.

It can also be provided, that the at least one application head, after executing a respective lowering movement, applies packaging blanks to the several different groupings or to the several beverage containers of the several different groupings with a time delay. In this way, a force can be kept low, which force must be provided at a certain point in time by the at least one application head for applying packaging blanks.

Embodiments in which the at least one application head executes the lowering movement oriented in the direction of the respective grouping and, in doing so, applies the respective packaging blank to the beverage containers already aligned with respect to one another by the at least one application head pressing a respective beverage container of a respective grouping into a respective opening of the respective packaging blank, so that the beverage containers of a respective grouping pressed into the openings of the respective packaging blank are held together via the respective packaging blank in a non-positive and/or positive-locking manner. It is possible in this case that the at least one application head for pressing the beverage containers into the openings applies a respective defined force to the packaging blank in the region of a respective opening, the respective defined force being applied to the packaging blank with a time offset along the circumferential course of a respective opening.

It is possible that the packaging blank is aligned horizontally oriented above the respective beverage containers of a particular grouping before the beverage containers of a particular grouping are pressed into the openings via at least one application head. It is also possible that the at least one application head has several manipulation elements. A respective manipulation element can be guided in the area of a respective opening against the packaging blank, which is oriented horizontally at least up to that point, in order to press a respective beverage container into a respective opening via a contact surface under the application of force. The contact surface can have a curved and/or an inclined course relative to the packaging blank which is oriented horizontally at least up to that point.

It may be that the packaging blank has for at least one of its openings and preferably for each of its openings a plurality of retaining tabs which, when the beverage containers of a respective grouping are pressed into the openings, are arranged below a respective upper edge of a respective beverage container, so that the packaging blank is thereupon held on the beverage containers substantially immovably in the axial direction relative to the beverage containers via its retaining tabs. It is possible that the retaining tabs are aligned or pre-bent before the beverage containers are pressed into the openings, so that the retaining tabs point away from the packaging blank in an upward direction.

In various designs, one step of the process can include pretreatment of the packaging blank to reduce a respective resistance force, which respective resistance force the packaging blank forms in an edge area of the openings when applied to the respective multiple beverage containers of a respective grouping. It may be that a respective mean diameter of the openings is increased during pretreatment to reduce a respective resistance. Alternatively or in addition to this, it is possible that during pre-treatment fixing tabs or holding tabs formed in a respective edge region of the openings are bent or pre-bent at least in some areas so that the fixing tabs or holding tabs then project from a plane in which the openings are arranged. It is also conceivable that the packaging blank is pressed onto a device with at least one expansion die during pretreatment. In this case, it is possible that the number and arrangement of the expansion dies corresponds to the number and arrangement of the openings of the packaging blank, the packaging blank being pressed onto the at least one expansion die in such a way that the at least one expansion die passes through the openings at least in some areas. If a plurality of expansion matrices are provided, the plurality of expansion matrices can be combined to form a format part.

One aspect may therefore concern a format part for the pretreatment of flat packaging blanks each having several openings, which format part has a carrier preferably in the form of a support plate and comprises a plurality of expansion matrices, wherein it is provided that the plurality of expansion dies are each arranged on the support preferably designed as a support plate and each taper at least in sections in the opposite direction to the support preferably designed as a support plate.

It is also conceivable that during the pre-treatment, incisions and/or perforations are made in the edge areas of the openings. In particular, it is possible that radial incisions and/or radial perforations are made in the edge areas.

Alternatively, or in addition to this, it is conceivable that during the pretreatment the respective edge area of the several openings is moistened or acted upon with liquid. Furthermore, it is possible that during the pre-treatment the respective edge area of the several openings is heated.

The application head can also have several manipulation elements, wherein a respective manipulation element is placed on the packaging blank in the region of a respective opening and, when placed on the packaging blank, is rotated in the region of the respective opening, as a result of which the respective defined force provided for pressing the respective beverage container into the respective opening is applied to the packaging blank with a time offset along the circumferential course of the respective opening.

It has proved to be successful if the at least one application head has at least one suction and/or gripping instrument, which at least one suction and/or gripping instrument holds the packaging blank at the at least one application head temporally before and/or temporally during the pressing of the beverage containers of a respective grouping into the openings. In particular, it is possible that the at least one suction and/or gripping instrument holds the packaging blank on the at least one application head via negative pressure temporally before and/or temporally during the pressing of the beverage containers of a respective grouping into the openings.

In various forms of embodiments, the at least one application head can comprise at least one centering device, which centering device restores, if required, the alignment of the several beverage containers of a respective grouping with respect to one another in a timely manner prior to the application of a respective packaging blank, which alignment is formed immediately upon placement of the beverage containers on the horizontal conveying device. The at least one centering device can be formed by a rigid frame, which frame is coming from above and is guided around a respective grouping, and which frame, as a result of this, restores, as required, the alignment of the several beverage containers of a respective grouping with respect to one another, which alignment is required for the application of a respective packaging blank and which alignment is formed immediately upon placement of the grouping on the horizontal conveying device. The at least one centering device can also be formed by a plurality of centering elements, which centering elements perform a closing and opening movement and thereby restore, as required, the alignment of the plurality of beverage containers of a respective grouping with respect to one another, which alignment is provided for the application of a respective packaging blank and which alignment is formed immediately upon placement of the beverage containers on the horizontal conveying device.

Within the context of the method, the beverage containers can be formed by beverage cans. It is also possible that the beverage containers are formed by beverage bottles and especially by glass bottles and/or PET bottles.

The invention furthermore concerns an apparatus for producing a multipack made of several beverage containers. The apparatus may, if necessary, be designed for the implementation of the previously described embodiments of the method according to the invention. Features which have already been described above for various embodiments of the method may also be provided for embodiments of the apparatus described below and are not mentioned several times. Likewise, features which are described below, which concern various embodiments of the apparatus, may be provided for in the method described above. The apparatus comprises a horizontal conveying device for moving groupings each comprising several beverage containers.

Furthermore, the apparatus comprises at least one working device, which working device can apply a respective packaging blank to the groupings, each grouping comprising a plurality of beverage containers, so that the beverage containers of a respective grouping pass through openings in the packaging blank and are held together by the respective packaging blank.

The apparatus comprises at least one handling apparatus, by which the beverage containers of a respective grouping can be deposited or placed on the horizontal conveying device in such a way, that the beverage containers of a respective grouping are already in an alignment with respect to one another upon placement on the horizontal conveying device, which alignment is required and/or provided for the immediate application of the respective packaging blank. In various embodiments, the apparatus can comprise at least one handling apparatus, by which handling apparatus the beverage containers of a respective grouping can be placed or deposited on the horizontal conveying device in such a way that the beverage containers of a respective grouping, immediately upon placement on the horizontal conveying device, have an orientation and/or alignment provided and required for the application of the respective packaging blank, and wherein it is provided that the beverage containers of a respective grouping can be placed or deposited on the horizontal conveying device by the at least one handling apparatus in such a way that the groupings are spaced apart from one another in a transport direction or in a conveying direction of the horizontal conveying device immediately upon placement on the horizontal conveying device.

The groupings can therefore be set down or placed on the horizontal conveying device by the at least one handling apparatus, if necessary, the groupings are placed on the horizontal conveying device in a conveying direction at a distance from one another.

The at least one horizontal conveying device can have a circumferential conveyor belt or an endless circumferential traction device, on which circumferential conveyor belt or endless circumferential traction device the beverage containers of a respective grouping are deposited.

The apparatus can be designed or equipped in such a way, that the groupings, each comprising several beverage containers, can be moved via the horizontal conveying device into a working area of the at least one working device consistently without surface contact of their lateral surface areas to any retaining elements and/or guiding elements or guiding rails.

Embodiments have been proven useful, in which the at least one handling apparatus is formed by at least one multi-axis robot or by at least one industrial robot.

The apparatus may optionally comprise a control and/or regulating device connected to the horizontal conveying apparatus, the control and/or regulating device being able to control the horizontal conveying apparatus for the uninterrupted movement of the groupings placed or deposited thereon.

Furthermore, the working device can have at least one application head, whereby the at least one application head can perform a lowering movement oriented in the direction of a respective grouping, in order to apply packaging blanks to groupings.

It is conceivable, that the at least one application head can be moved back and forth between the horizontal conveying device and a stack of several packaging blanks positioned laterally beside the horizontal conveying device.

Furthermore, the at least one application head can be designed in such a way, that the at least one application head can apply several packaging blanks to several groupings with a time delay after performing a respective lowering movement.

It is also conceivable, that the at least one application head comprises at least one centering device, which centering device can restore, if required, an alignment of the several beverage containers of a respective grouping with respect to one another, which alignment is provided for the application of the respective packaging blank.

It may be that the at least one application head comprises a carrier as well as a plurality of manipulation elements suspended from the carrier, via which the packaging blank can be subjected to a defined force in the region of a plurality of openings, so that a respective beverage container of a respective grouping is pressed into a respective opening of the packaging blank. The plurality of manipulation elements arranged suspended on the carrier can be designed in such a way that the plurality of manipulation elements arranged suspended on the carrier can apply a respective defined force to the packaging blank along the respective circumferential course of the respective opening with a time offset for pressing a respective beverage container into a respective opening.

It may be that the several manipulation elements each form a contact surface via which the respective manipulation element can apply the defined force in the area of the respective opening to the packaging blank and which contact surface in the area of the respective opening is oriented obliquely relative to the packaging blank and/or can be placed on the packaging blank with a curved course.

Furthermore, it is conceivable that the several manipulation elements can each perform a rotational movement to apply the defined force along the circumferential course of the respective opening with a time offset.

It is possible that the at least one application head comprises at least one suction and/or gripping instrument, via which at least one suction and/or gripping instrument the packaging blank can be releasably fixed to the at least one application head during the pressing of a respective beverage container into a respective opening. It has proved to be particularly useful in this respect when the at least one suction and/or gripping instrument can fix the packaging blank detachably and via negative pressure to the at least one application head while a respective beverage container is pressed into a respective opening.

The at least one application head may comprise several lateral partitions between which a respective packaging blank intended for application to beverage containers of a respective grouping may be arranged positively or with little clearance.

Furthermore, it is possible that the device comprises a pretreatment module for preparing the packaging blank for application to the beverage containers of a respective grouping. The pretreatment module may comprise at least one device designed to reduce a resistance force occurring in a respective edge region of the openings when the packaging blank is applied. It is conceivable that the at least one device of the pretreatment module comprises at least one expansion die. The at least one expansion die can be detachably arranged in the pretreatment module. Furthermore, the at least one device of the pretreatment module may comprise a plurality of expansion matrices, wherein the plurality of expansion matrices may be arranged in different arrangements and/or in different numbers in the pretreatment module. It is also possible that the at least one device of the pretreatment module comprises at least one cutting device and/or at least one perforating device. Furthermore, it is possible that the at least one device of the pretreatment module comprises at least one cutting device and/or at least one perforating device. It is also conceivable that the at least one device of the pretreatment module comprises at least one moistening device, in particular at least one vaporization device, and/or that the at least one device of the pretreatment module comprises at least one heating device.

Furthermore, it may be the case, that the apparatus is designed to assemble several beverage containers into a respective multipack, which several beverage containers are formed by several beverage cans and/or by several beverage bottles.

BRIEF DESCRIPTION OF THE FIGURES

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged to facilitate an understanding of the invention.

Figure 1:
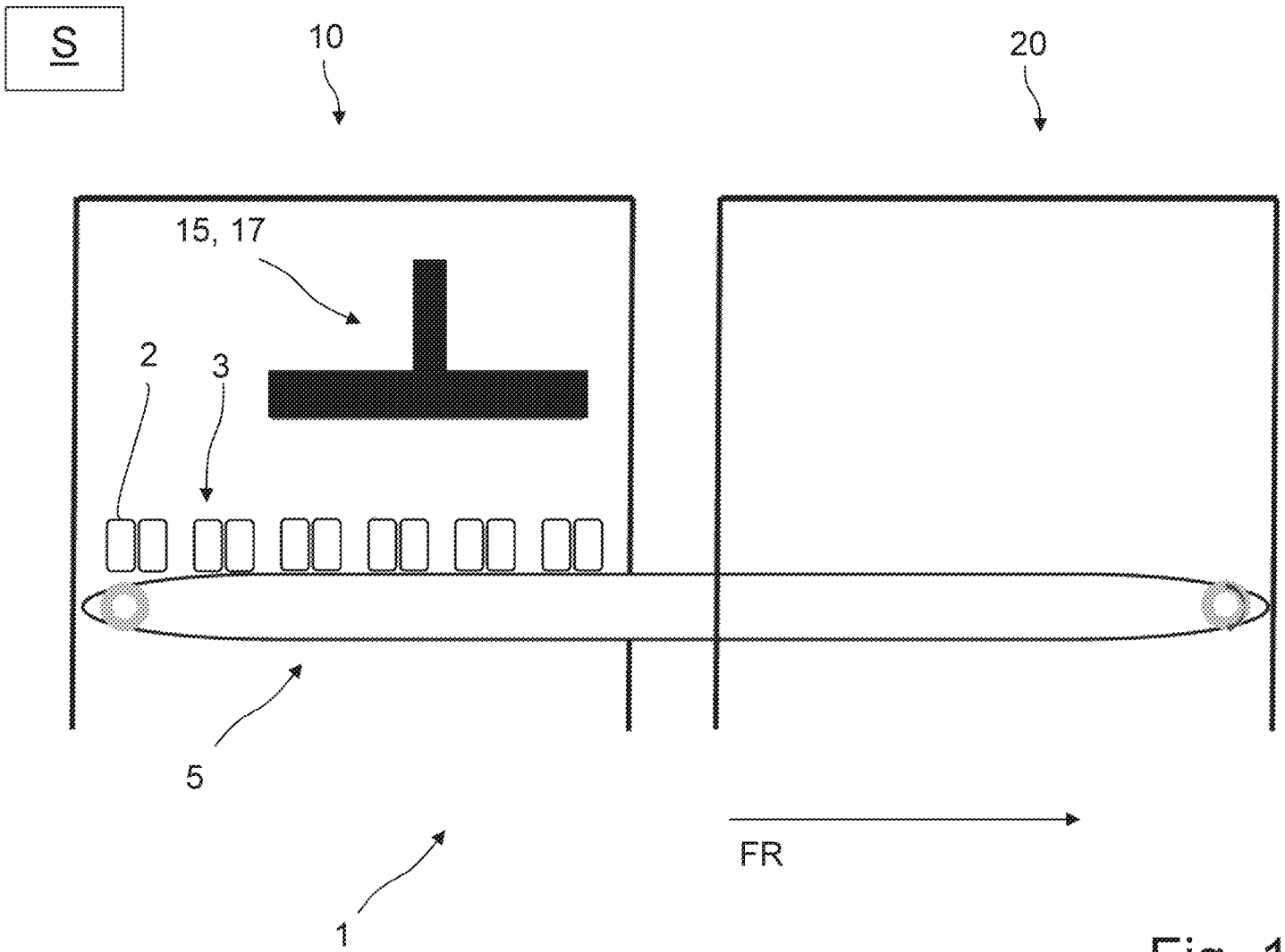
FIG. 1 shows a schematic view of an embodiment of the apparatus according to the invention and illustrates individual steps as they may be provided for in various embodiments of the method according to the invention.

The same or equivalent elements of the invention are designated by identical reference characters. Furthermore, and for the sake of clarity, only the reference characters relevant for describing the respective figure are provided. It should be understood, that the embodiments described are only examples describing an embodiment of the apparatus and/or method according to the invention. They are not intended to limit the scope of the disclosure.

The embodiments, examples and variants described in the preceding paragraphs, the claims or in the following description of the figures and in the figures themselves, including their different views or respective individual features, may be used independently or in any combination. Features described in connection with a specific embodiment are applicable to all other embodiments as well, unless the features are incompatible.

Even if in the context of the figures in general the terms "schematic" representations and views are used, this does not in any way mean that the figure representations and their description should be of secondary importance with regard to the disclosure of the invention. The person skilled in the art is quite capable of extracting enough information from the schematic and abstract representations, in order to facilitate his understanding of the invention, without his understanding being impaired in any way by the illustrated and possibly not exactly scaled proportions. The figures thus enable the person skilled in the art as reader to derive a better understanding of the idea according to the invention, which is described in the claims as well as in the general part of the description in more general and/or abstract terms, on the basis of the more specifically explained implementations of the method according to the invention and the more specifically explained functioning of the apparatus according to the invention.

DETAILED DESCRIPTION OF THE INVENTION

FIG. 1 shows a schematic view of an embodiment of the apparatus 1 according to the invention and illustrates individual steps as they may be provided for in various embodiments of the method 100 according to the invention.

Figure 10:
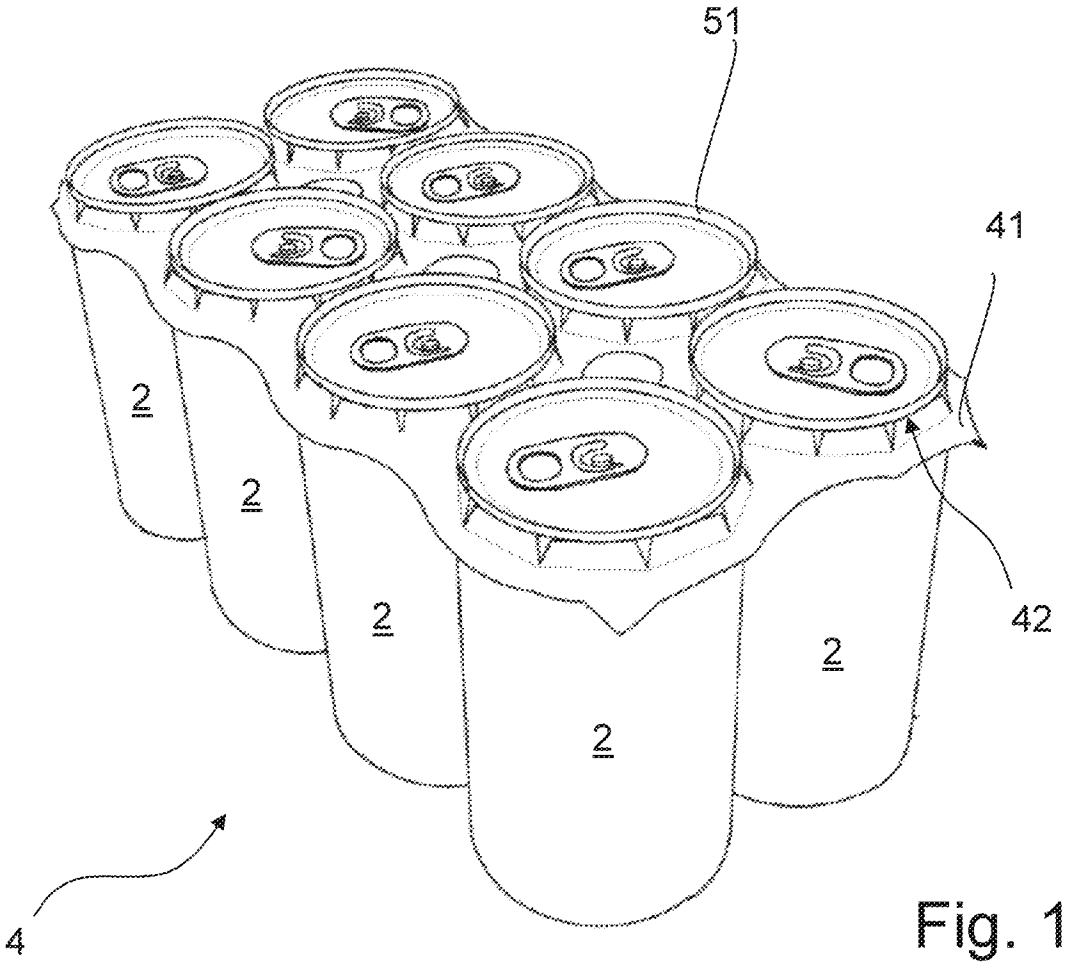
FIG. 10 shows a schematic view of a multipack, which can be produced with various embodiments of the apparatus according to the invention and with various embodiments of the method according to the invention.

Apparatus 1, which is shown in the embodiment according to FIG. 1, can produce a multipack 4 as shown, for example, in FIG. 10. Such a multipack 4 comprises several beverage containers 2 and a packaging blank 41. For each of the beverage containers 2 the packaging blank 41 has an assigned opening 42, through which opening 42 the respective beverage container 2 passes with an upper part, so that all beverage containers 2 of the respective multipack 4 are held together form-fittingly and/or force-fittingly by the common packaging blank 41.

The embodiment of a multipack 4 as shown in FIG. 10 comprises eight beverage containers 2, each of which is designed as a beverage can. In further embodiments it can be provided, for example, that a multipack 4 comprises only two beverage containers 2, four beverage containers 2 or six beverage containers 2. As an alternative to the embodiment shown in FIG. 10, the beverage containers 2, which are components of a respective multipack 4, can also be beverage bottles or PET bottles. The beverage bottles or PET bottles can pass with an upper head area and/or upper neck area through a respective assigned opening 42 of a packaging blank 41 and be held together form-fittingly and/or force-fittingly by the respective packaging blank 41. A multipack not shown in the figures of the present patent application may therefore, for example, be designed as a six-pack.

Figure 2:
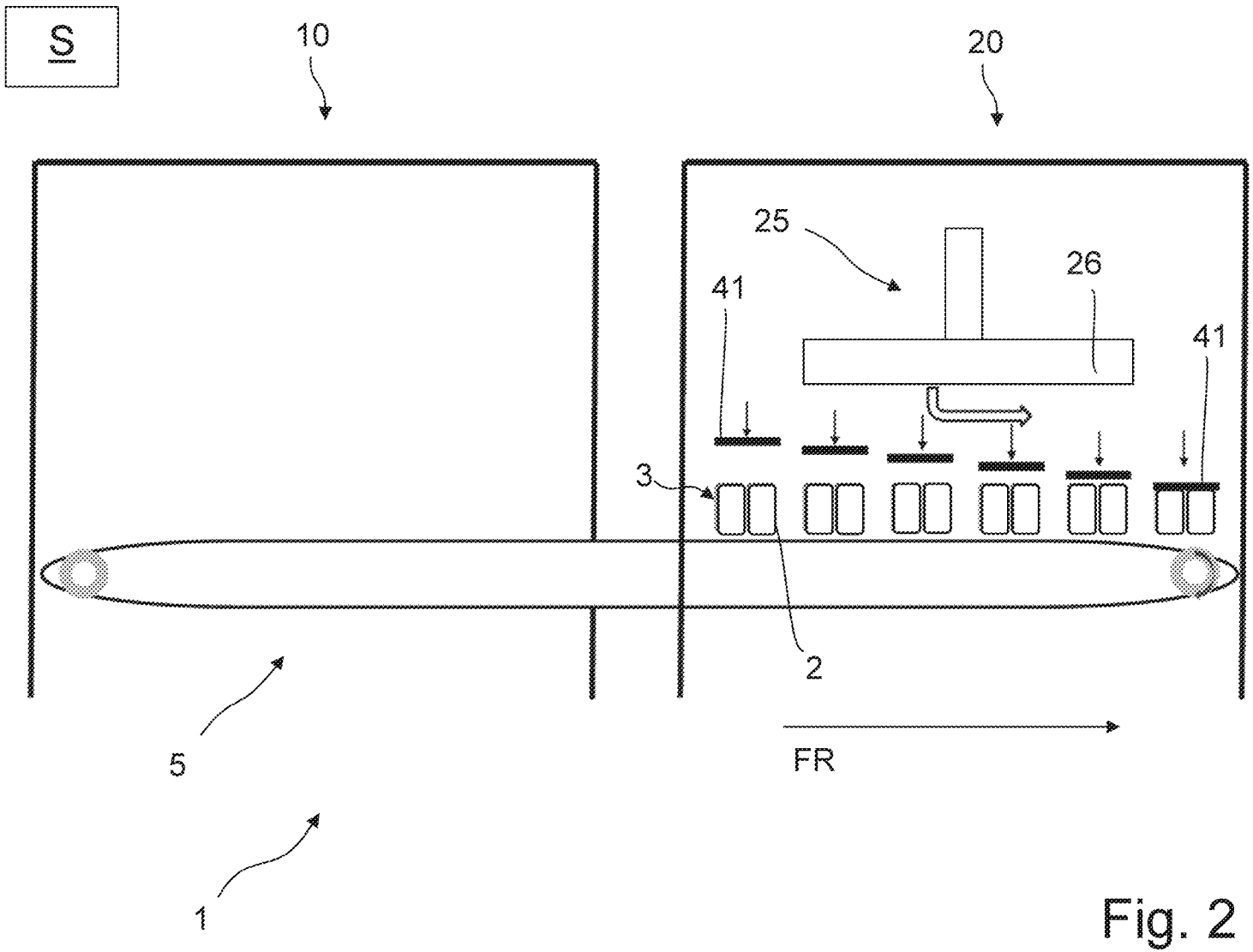
FIG. 2 shows further aspects of the embodiment of an apparatus according to FIG. 1 and illustrates further steps, which may be provided for in various embodiments of the method according to the invention.
Figure 3:
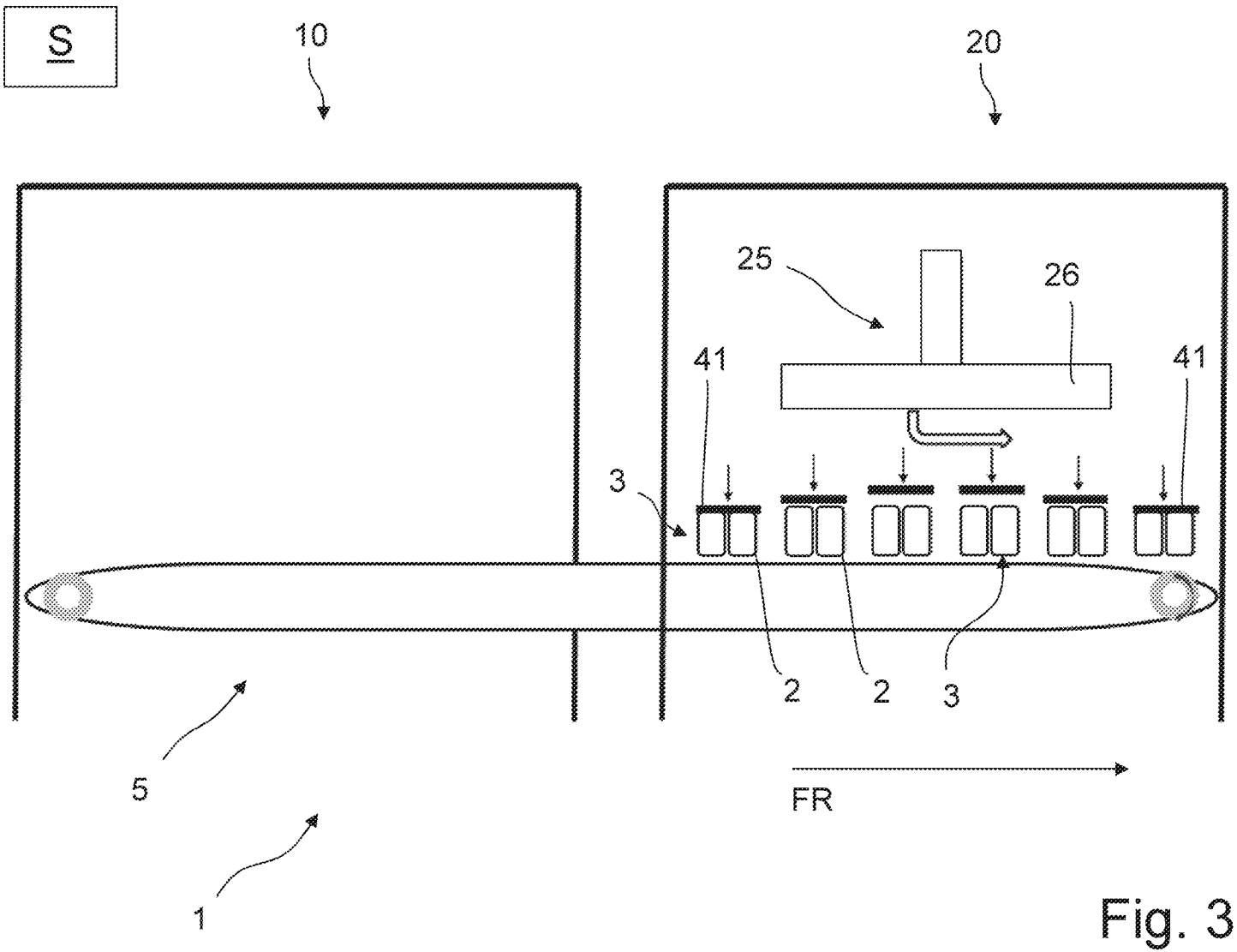
FIG. 3 shows a further embodiment of an apparatus according to the invention and illustrates further aspects as they may be provided for in various embodiments of the method according to the invention.

In FIGS. 1 to 3 the beverage containers 2 are only shown schematically for reasons of clarity. In order to assemble or produce the respective multipack 4, the apparatus 1 comprises a first module 10, a second module 20 and a horizontal conveying device 5, which horizontal conveying device 5 can transfer beverage containers 2 from the first module 10 to the second module 20. In the conveying direction FR of the horizontal conveying device 5 the second module 20 is arranged downstream of the first module 10.

In order to be able to produce multipack 4 according to the embodiment shown in FIG. 10, beverage containers 2, which are provided for the respective multipack 4, must have a relative arrangement with respect to each other, in which arrangement the openings 42 of the packaging blank 41 are aligned with the beverage containers 2 in such a way that an upper area of the beverage containers 2 can subsequently be pushed through the openings 42. If the beverage containers 2 are not aligned with respect to one another appropriately, the beverage containers 2 do not or only partially meet the openings 42 when the packaging blank 41 is applied, thereby causing problems during the application of the respective packaging blank 41.

In the case of the apparatus known from the prior art, groupings 3 are often formed from several beverage containers 2 using dividers, which groupings 3 each comprise the number of beverage containers 2 intended for the respective multipack 4. In order to be able to guarantee that the beverage containers 2 of such a grouping 3 are in an alignment with respect to each other upon application of a respective packaging blank 4, so that the packaging blank 41 can be applied to the beverage containers 2, apparatuses known from the prior art have guiding rails, which guiding rails extend in the conveying direction FR along the horizontal conveying device 5. Furthermore, retaining elements are known and provided, of applicable, which retaining elements are designed as a component of the respective divider, which retaining elements are moved together with the beverage containers 2 and which support the beverage containers 2 of a respective grouping 3 during their movement along the horizontal conveying device 5. In contrast, the apparatus 1 according to the embodiment shown in FIG. 1 has a simplified structure. In apparatus 1 according to FIG. 1 corresponding retaining elements and/or guide rails are not provided for. Thus, the beverage containers 2 of a respective grouping 3 contact the horizontal conveying device 5 exclusively via their respective base area, whereby during a movement of the beverage containers 2 by the horizontal conveying device 5, the lateral surface areas of the beverage containers 2 are at no time in contact with any guide rails and/or retaining elements.

Figure 11:
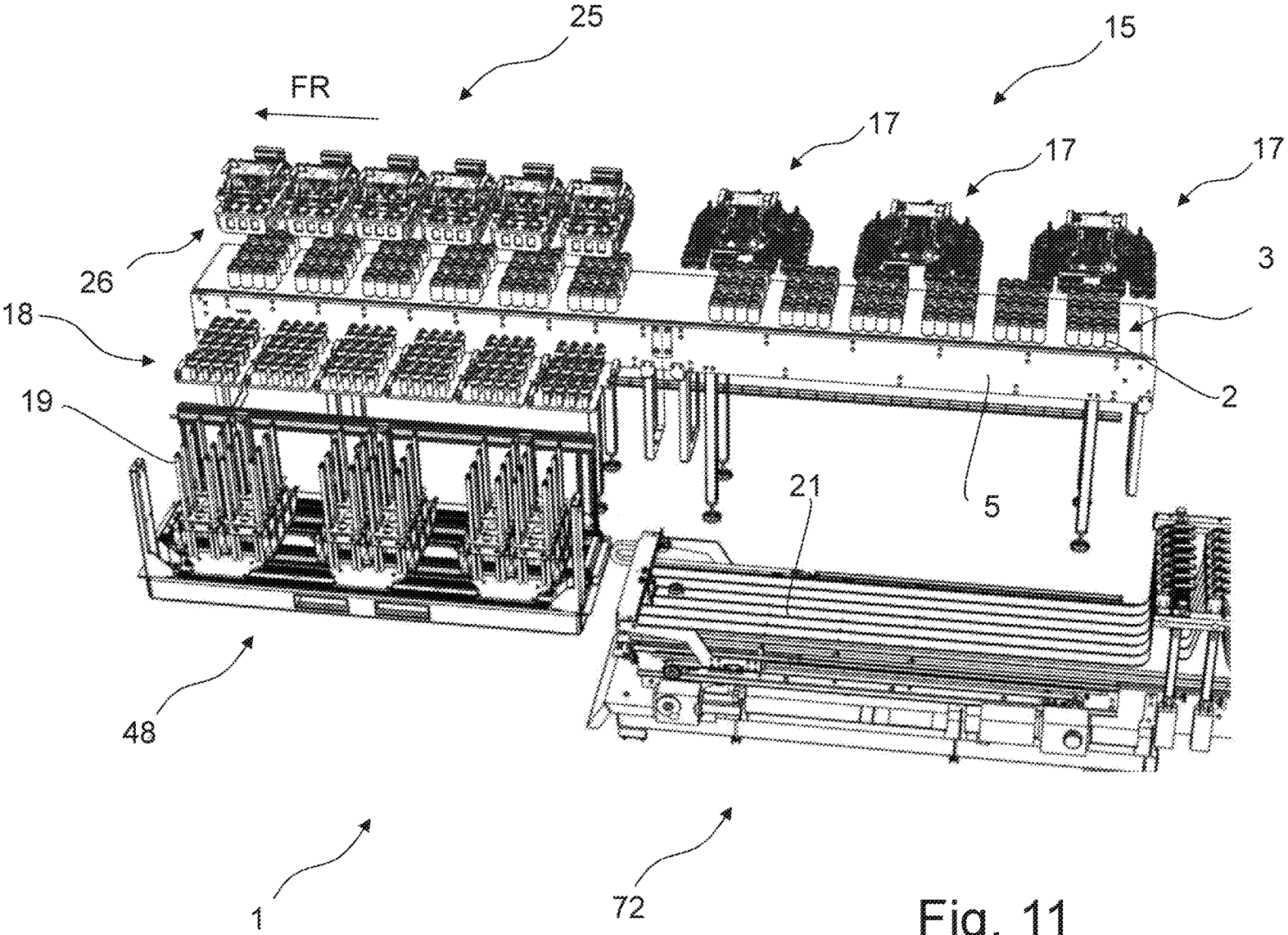
FIG. 11 shows a schematic perspective view of a further embodiment of the apparatus according to the invention.

In order to be able to guarantee that a respective packaging blank 41 can be applied to the beverage containers 2 without any problems or to ensure that the beverage containers 2 of a respective grouping 3 are in a suitable alignment with respect to each other for the application of the packaging blank 41, the first module 10 comprises a handling apparatus 15, which comprises one gripping head 17 in the embodiment shown and which can comprise more than one gripping head 17 in further embodiments (see FIG. 11). The handling apparatus 15 is only shown schematically in FIG. 1 and can be designed in practice, for example, as an industrial robot or multi-axis robot. By the handling apparatus 15 or by the gripping head 17, the beverage containers 2 are received from a supply unit 72 (see FIG. 11), then the beverage containers 2 are moved in the direction of the horizontal conveying device 5 and deposited or placed on the horizontal conveying device 5 from above.

The deposition or placement of the beverage containers 2 on the horizontal conveying device 5 takes place via the handling apparatus 15 in such a way, that immediately during the deposition a grouping 3 of beverage containers 2 is formed on the horizontal conveying device 5, wherein the number of beverage containers 2 within the grouping directly corresponds to the number of beverage containers 2 of the respective multipack 4 to be produced (see FIG. 10). In addition, the beverage containers 2 are deposited or placed on the horizontal conveying device 5 by the handling apparatus 15 in such a way, that the beverage containers 2 within a respective grouping 3, which is formed on the horizontal conveying device 5, immediately upon deposition on the horizontal conveying device 5 already are in alignment with respect to one another, which alignment is suitable for the application of the respective packaging blank 41. Since this type of grouping requires no division with retaining elements and/or guidance by rails, there is no risk of the beverage containers 2 being scratched or damaged due to surface contact with any guiding rails and/or retaining elements. In the design according to FIG. 1, the beverage containers 2 are placed on the horizontal conveyor 5 so that a surface contact is formed between the beverage containers 2 and the horizontal conveyor 5. However, it is also possible that an outer packaging, such as a tray, is transported by the horizontal conveyor 5, wherein the beverage containers 2 of a respective grouping 3 are deposited on the outer packaging transported by the horizontal conveyor 5 in such a way that the beverage containers 2 of a respective grouping 3 have an alignment to one another provided for the application of the respective packaging blank 41 immediately when deposited on the outer packaging transported by the horizontal conveyor 5.

Temporally, after the groupings 3 have been formed on the horizontal conveying device 5, each grouping 3 comprising several beverage containers 2 aligned with respect to each other for the application of packaging blanks 41, the groupings 3 are moved via the horizontal conveying device 5 in a conveying direction FR. The horizontal conveying device 5 is connected to a control and/or regulating device S, which control and/or regulating device S controls the horizontal conveying device S for the uninterrupted movement of groupings 3 at the same or a constant conveying speed over the course of time, which groupings 3 have been deposited or placed on the horizontal conveying device 5. The groupings 3 then leave the first module 10 and reach the second module 20, which is located downstream of the first module 10 in conveying direction FR.

In order to reduce the risk that the beverage containers 2, which are aligned with respect to one another for the application of a packaging blank 41 immediately upon placement on the horizontal conveying device 5, unintentionally shift relative to one another during a movement in the conveying direction FR, it may be provided that the horizontal conveying device 5 has an endless circumferential traction device or a circulating conveyor belt, wherein between the endless circumferential traction device or circulating conveyor belt and the beverage containers 2 a high static friction is provided. For example, the endless circumferential traction device or the circulating conveyor belt can have a plurality of studs and/or consist of a material, over which plurality of studs and/or material a high level of static friction can be provided between the beverage containers 2 and the endless circumferential traction device or the beverage containers 2 and the circulating conveyor belt.

The schematic view in FIG. 2 further illustrates, that the second module 20 has a working device 25, which includes an application head 26 and which is only shown schematically in FIGS. 2 and 3. The detailed construction of such an application head 26, as it may also be intended for apparatus 1 according to the design example in FIGS. 1 to 3, is shown in the following FIGS. 4 to 9. The working device 25 can also be designed as a multi-axis robot or industrial robot which comprises at least one application head 26 and which is capable of simultaneously receiving several packaging blanks 41 from a stack, which stack is not shown in the figures. After receiving or picking up several packaging blanks 41, the application head 26 is moved in the direction of the horizontal conveying device 5, so that the application head 26, together with the several packaging blanks 41 still held by the application head 26 up to this point, is located above the several groupings 3, onto which the packaging blanks 41 are to be applied. Following this, the application head 26 is lowered in the direction of groupings 3 and subsequently applies the packaging blanks 41 to groupings 3. For the design example shown in FIGS. 1 to 3, it is not absolutely necessary for the application head to take 26 packaging blanks 41 directly from a magazine 48 (see FIG. 11). It is also possible that a transfer tool 90 is provided which takes packaging blanks 41 from a magazine 48 and initially places them on several dies 18. The application head 26 can then pick up the packaging blanks 41 placed on the several dies 18 and apply them to groupings 3.

Since the groupings 3 are moved in time without interruption by the horizontal conveying device 5 in the conveying direction FR during the application of the packaging blank 41, the application head 26 is moved along with the groupings 3 in the conveying direction FR after lowering and until the packaging blanks 41 are completely applied to the groupings 3. When all packaging blanks 41 have been applied to the groupings 3, the beverage containers 2, which are part of a respective grouping 3, together with the respective packaging blank 41 form a multipack 4 (see FIG. 10).

In order to apply the packaging blanks 41 to the groupings 3, the packaging blanks 41 must be pressed onto the respective beverage containers 2 in the direction of the respective beverage containers 2. Accordingly, the working device 25 or the application head 26 must apply a certain force to the respective packaging blank 41 for the application of each packaging blank 41 to the beverage containers 2, which force acts in a downward direction or in the direction of the respective beverage containers 2. In order to avoid that the working device 25 or the application head 26 has to apply a relatively high total force at a certain point in time, embodiments according to FIG. 2 have proven to be successful, in which embodiments the working apparatus 25 or the application head 26 applies the different packaging blanks 41 to the different groupings 3 with a time delay. In the embodiment according to FIG. 2, a packaging blank 41 is first applied to a grouping 3, which, in view of the conveying direction FR of the horizontal conveying device 5, is arranged at the front. Following this in a timely manner, packaging blanks 41 are successively applied to subsequent groupings 3 that are following the grouping 3, which is located foremost in view of the conveying direction FR of the horizontal conveying device 5.

As already mentioned in the context of FIG. 1, the beverage containers 2 of a respective grouping 3 are deposited or placed on the horizontal conveying device 5 by the handling apparatus 15 or a gripping head 17 in such a way, that the beverage containers 2 of a respective grouping 3 are in an alignment with respect to each other immediately upon deposition or placement on the horizontal conveying device 5, in order that packaging blanks 41 can be applied to the beverage containers 2 of a respective grouping 3 by the application head 26. In order to further reduce the risk, that beverage containers 2, which are already aligned for the application of a packaging blank 41, will unintentionally shift relative to one another during a movement from the first module 10 in the direction to the second module 20 and that subsequently a packaging blank 41 cannot be applied to a respective grouping 3 or will be applied to a respective grouping 3 only with problems, the working apparatus 25 or the application head 26 can comprise a centering device. If required, the centering device restores the alignment of the beverage containers 2 relative to one another, which alignment has already been formed immediately upon placement of the beverage containers 2 on the horizontal conveying device 5.

Furthermore, FIG. 2 illustrates once again that also in the area of the second module 20 no guiding rails or retaining elements extending in the conveying direction FR are provided, which guiding rails or retaining elements may be moved together with groupings 3, if applicable. Thus, also in the area of the second module 20 groupings 3 or beverage containers 2 are at no time in any surface contact with any guiding rails and/or retaining elements.

In the design according to FIGS. 1 and 2, it is intended that the handling device 15 or the gripping head 17 places beverage containers 2 as a grouping 3 on the horizontal conveyor 5. In alternative designs, however, it may also be provided that the application head places 26 beverage containers 2 as a grouping 3 on the horizontal conveyor 5 so that the beverage containers 2 of a respective grouping 3 are already in an alignment with one another intended for the application of the respective packaging blank 41 immediately when they are placed on the horizontal conveyor 5. Following this, the application head 26 can receive a packaging blank 41 and then apply it to the respective grouping 3 still arranged on the horizontal conveyor 5.

Figure 4:
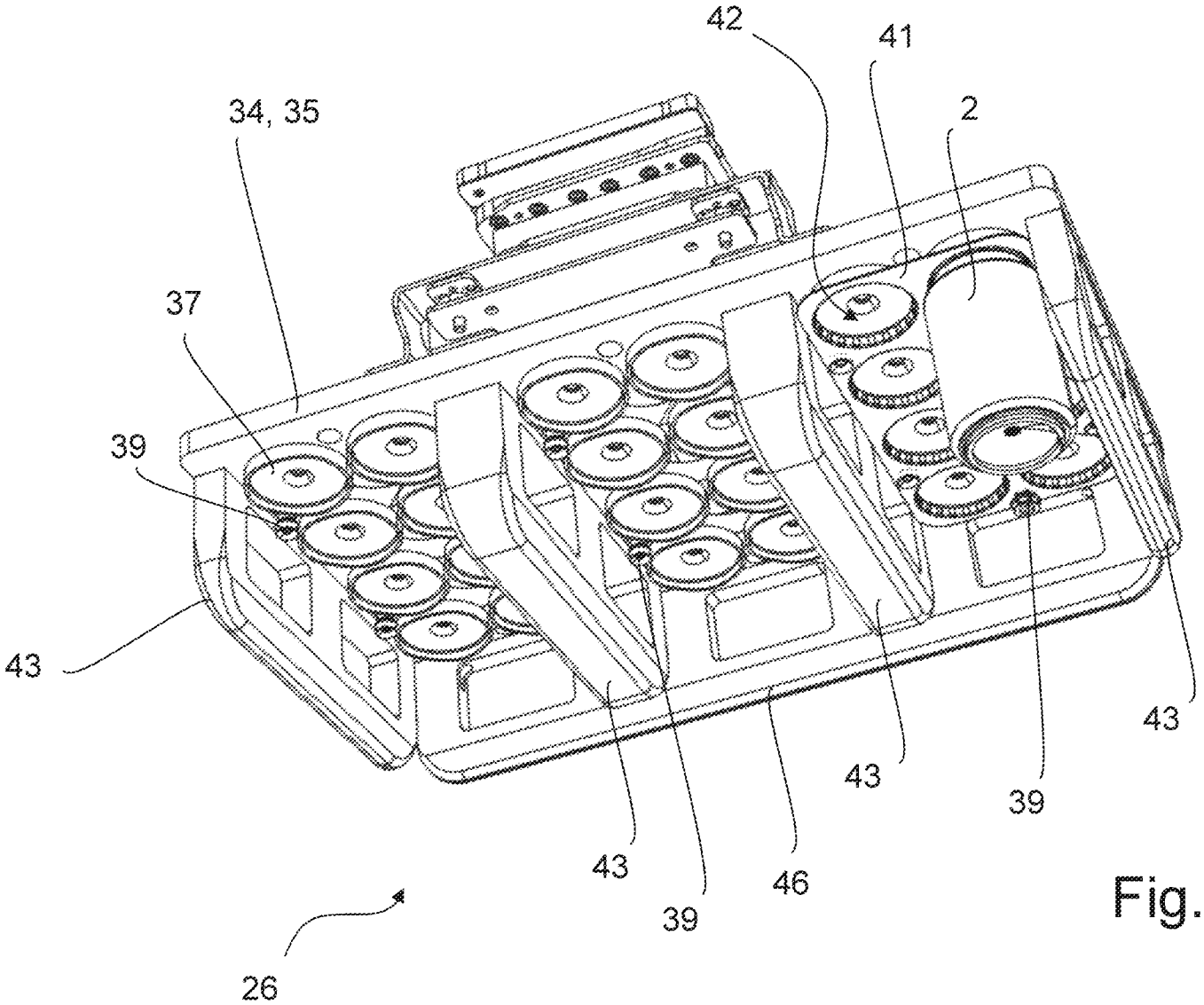
FIGS. 4 to 6 each show a schematic view of an embodiment of an application head as it may be provided for various embodiments of the apparatus according to the invention.
Figure 5:
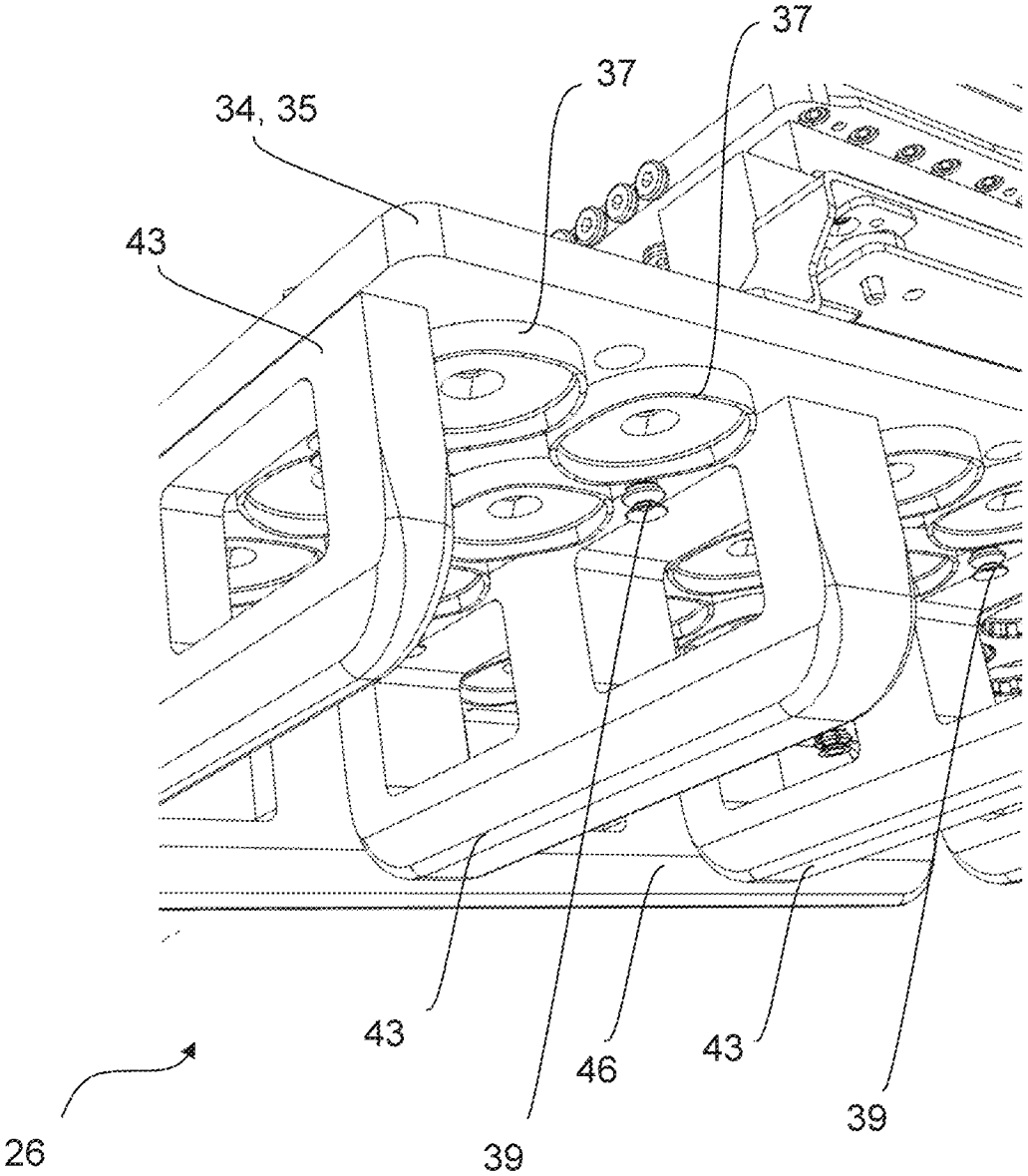

FIG. 3 shows a further embodiment of an apparatus 1 according to the invention and illustrates further aspects, which may be provided for in various embodiments of the method 100 according to the invention (see FIG. 5). The application head 26 can also have a structure for the design according to FIG. 3, as illustrated by the design example shown in the following FIGS. 4 to 9. The horizontal conveying device 5, as well as the first module 10, is designed here according to the embodiment shown in FIGS. 1 and 2, therefore reference is made to the previous description. Compared with the embodiments shown in FIGS. 1 and 2, the embodiment according to FIG. 3 differs in the way the flat packaging blanks 41 are applied via the working apparatus 25 or via the application head 26. As already mentioned in the description of FIG. 2, the packaging blanks 41 must be pressed onto the respective beverage containers 2 via the application head 26 in the direction of the respective beverage containers 2.

Thus, in order to apply each packaging blank 41, the application head 26 must apply a certain force to the respective packaging blank 41, which force acts in a downward direction or in the direction of the respective beverage containers 2. In the embodiment according to FIG. 3, in order that the application head 26 does not have to apply a relatively large force at a certain point in time, the packaging blanks 41 are applied to the groupings 3 via the application head 26 successively with a time delay.

An overview of FIG. 2 and FIG. 3 shows, that the order, in which the packaging blanks 41 are applied to the groupings 3, differs in FIG. 3 from the embodiment described in FIG. 2. In FIG. 2, a packaging blank 41 is first applied to a grouping 3 arranged at the foremost position in view of the conveying direction FR of the horizontal conveying device 5 and the other groupings 3 follow subsequently. In contrast to this, in FIG. 3 a respective packaging blank 41 is arranged at least approximately simultaneously on a foremost located grouping 3 in view of the conveying direction FR and on a grouping 3 arranged at the rearmost in view of the conveying direction FR. Only following this in time, in FIG. 3, a respective packaging blank 41 is applied to the other groupings 3, which are located between the foremost located grouping 3 in view of the conveying direction FR and the rearmost located grouping 3 in view of the conveying direction FR.

Also for the groupings 3, which are located between the foremost located grouping 3 in view of the conveying direction FR and the rearmost located grouping 3 in view of the conveying direction FR, the application of packaging blanks 41 is carried out in pairs, so that two packaging blanks 41 are applied at least approximately simultaneously to two groupings 3 at a time.

Also in the embodiment according to FIG. 3, no guiding rail or guiding rails and/or retaining elements are provided within the area of the second module 20, which guiding rails and/or retaining elements could come into contact with the lateral surface areas of beverage containers 2. The movement of the beverage containers 2 in the area of the second module 20 takes place via the horizontal conveying device 5 without contact of lateral surface areas of the beverage containers 2 with any guiding rails and/or retaining elements.

Figure 6:
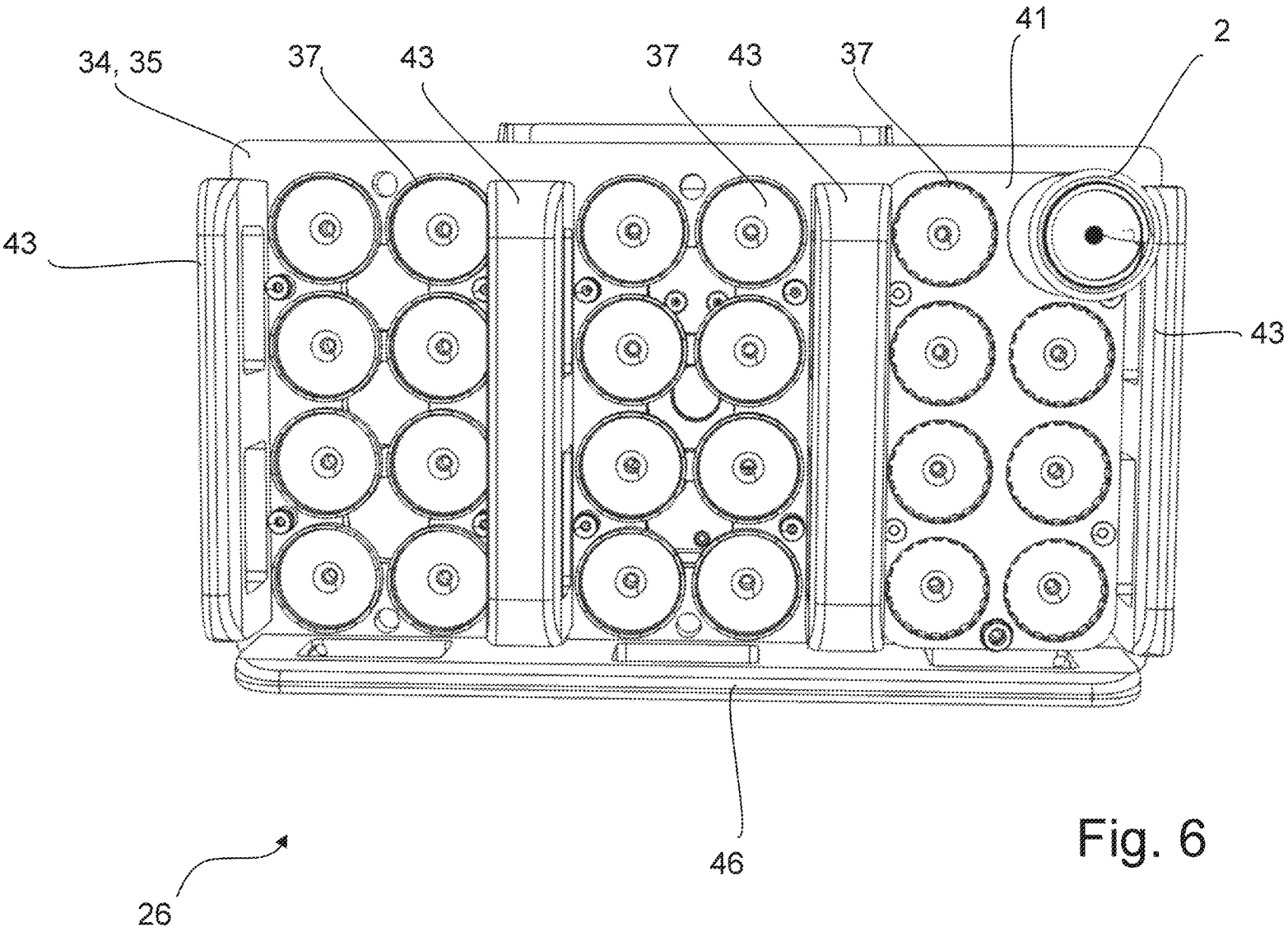

FIGS. 4 to 6 each show a schematic view of an embodiment of an application head 26, as it may be provided for various embodiments of the apparatus 1 according to the invention.

FIG. 4 illustrates that the application head 26 has a carrier 34, which is designed as a carrier plate 35 and to which several manipulation elements 37 are suspended. If the application head 26 is moved by an industrial robot 30, the carrier 34 or the carrier plate 35 remains in a horizontal orientation throughout.

Figure 7:
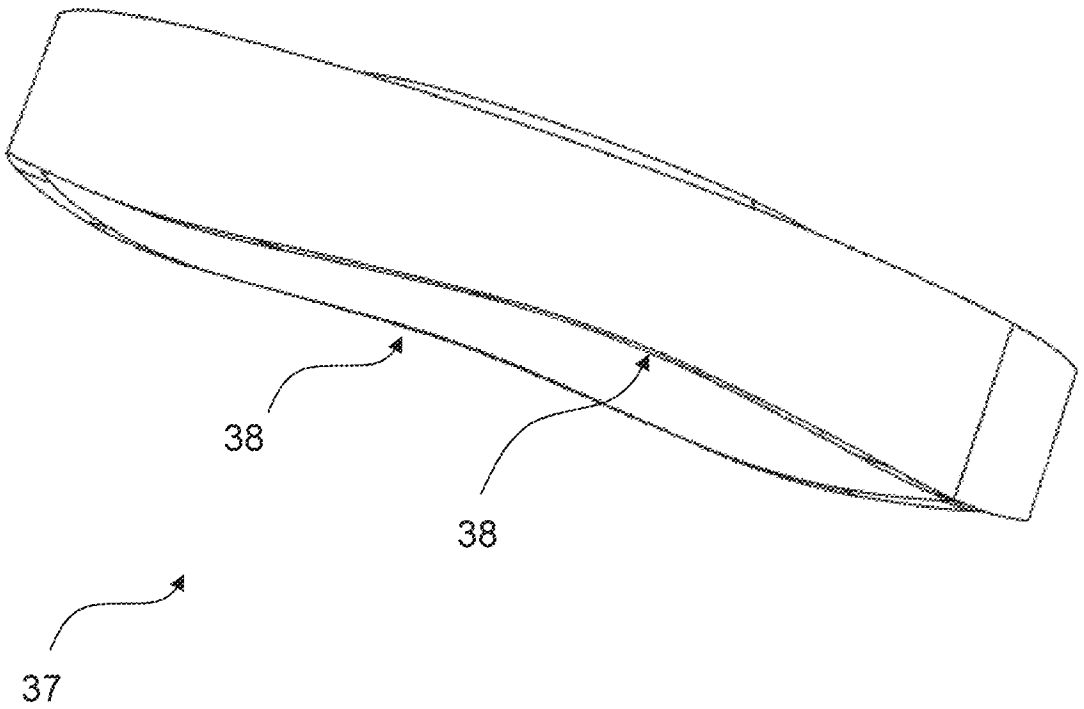
FIGS. 7 to 9 show individual details of a manipulation element of the application head according to the embodiment from FIGS. 2 to 4.
Figure 8:
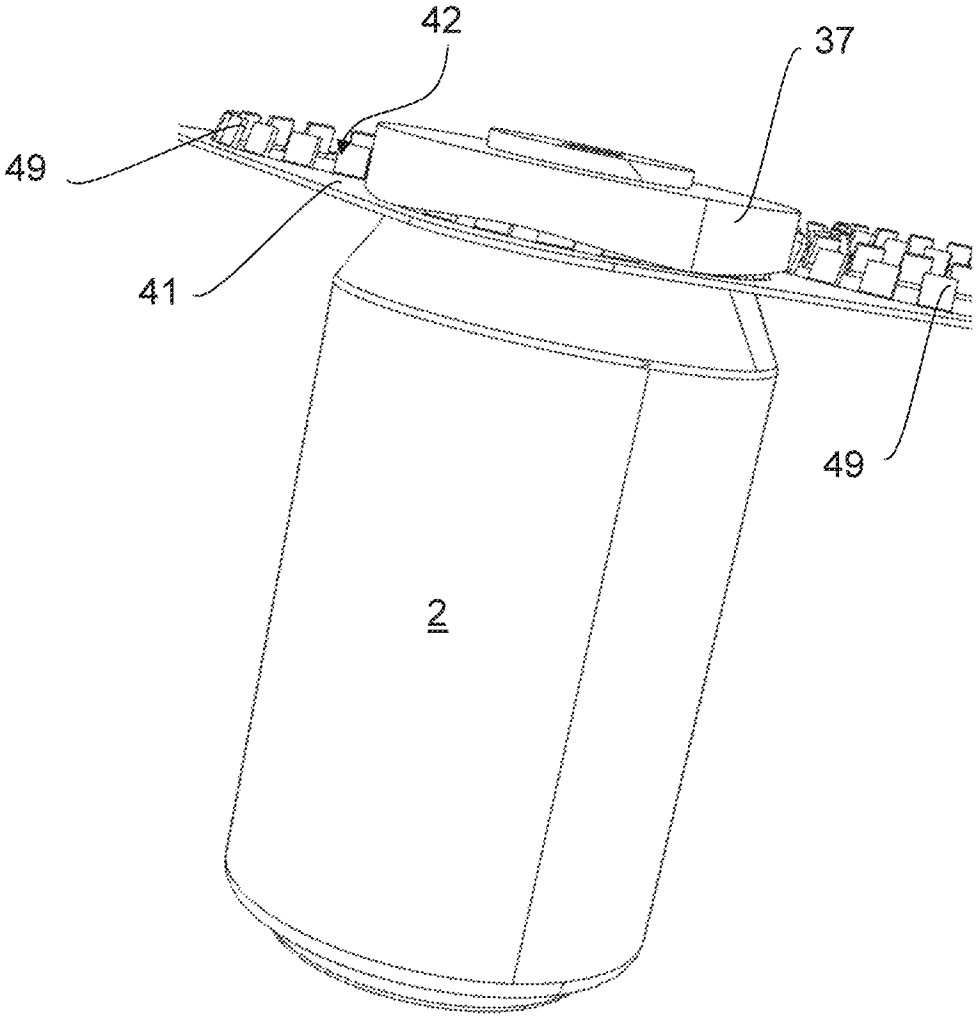
Figure 9:
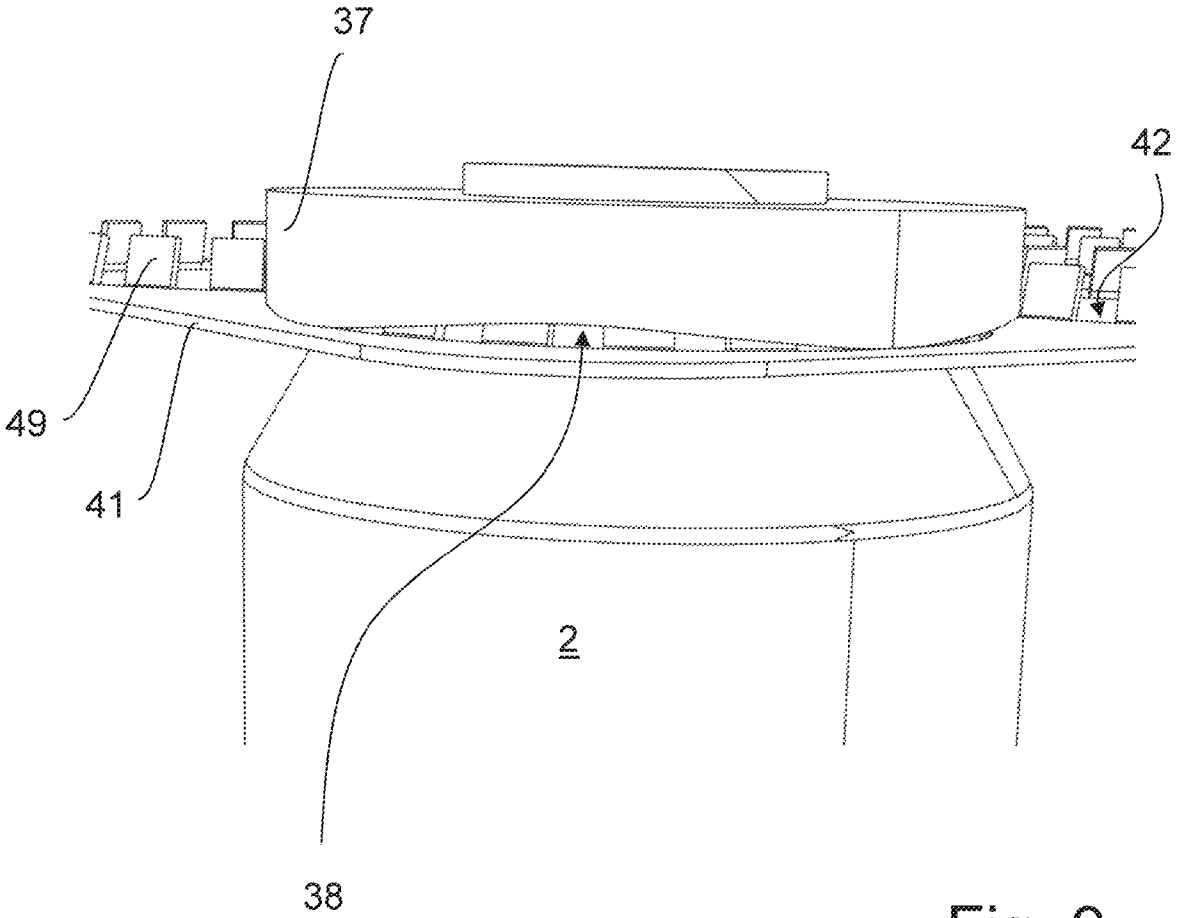

For all beverage containers 2 of each multipack 4 to be produced, the application head 26 comprises its own manipulation element 37, the design of which is shown in detail in FIGS. 7 to 9 and which comes into surface contact with the packaging blank 41 when it is applied to the beverage container 2 under the application of force. Via the application head 26, as shown in FIGS. 4 to 6, three packaging blanks 41 can be applied to beverage containers 2 at least approximately simultaneously, so that several beverage containers 2 can be combined into three Multipacks 4 via three packaging blanks 41 at least approximately simultaneously via the application head 26.

The perspective view according to FIG. 4 also shows that the application head 26 comprises several lateral partitions 43 and a rear wall 46. The side partitions 43 and the back wall 46 are oriented perpendicular to each other. The side partitions 43 and the rear wall 46 are also suspended from the support 34 and the support plate 35, respectively, from which support 34 and support plate 35 the handling elements 37 are also suspended.

The spacing between two adjacent lateral partitions 43 is selected in such a way that a respective packaging blank 41 can be arranged between two adjacent partitions 43 with a positive fit or with little play. The rear wall 46 defines a position for a packaging blank 41 arranged between adjacent partitions 43 in a further spatial direction. A packaging blank 41 can therefore be in contact with the rear panel 43 and with two adjacent side partitions 43 or only slightly spaced from the side partitions 43 or slightly spaced from the rear panel 46. Since the lateral partitions 43 and the rear wall 46 prevent a relative movement of a picked-up packaging blank 41 relative to the manipulation elements 37 in several spatial directions, it can be ensured with a high degree of certainty that the manipulation elements 37 hit a predetermined position of the packaging blank 41 precisely when the packaging blank 41 is applied.

The side partitions 43 also have another function, which becomes clear from a summary of FIGS. 1 and 4. As mentioned before, in the area of the first module 10 groupings 3 are formed from beverage containers 2, whereby these formed groupings 3 are moved at a distance from each other in the conveying direction FR via the horizontal conveyor 5 and in doing so enter the area of the second module 20. In order to be able to apply packaging blanks 41 precisely onto the groupings 3 so that the beverage containers 2 meet the openings 42, it is necessary that a relative spacing formed between successive groupings 3 corresponds very precisely to a specified nominal spacing. In the event that a beverage container 2 slips unintentionally during its movement over the horizontal conveyor 5, it is possible that this beverage container 2 is too close to an advancing grouping 3 or too close to a lagging grouping 3. In order to correct such an error or to then move the beverage containers 2 into a position where the beverage container 2 hits a particular opening 42 precisely when the packaging blank 41 is applied, the respective beverage container 2 is moved over the lateral partitions 43 as required. As FIG. 4 shows, the lateral partitions 43 taper in the opposite direction to the carrier 34. To apply the packaging blank 41, the application head 26 is moved in the direction of the beverage containers 2 or in the direction of the respective groupings 3, whereby the lateral partitions 43 are immersed in a free space formed between successive groupings 3. If a beverage container 2 is located in this free space, which has slipped unintentionally or whose position does not correspond to a desired position, a lateral partition wall 43 pushes this beverage container 2 back into an intended desired position. In this way, the beverage containers 2 hit the openings 42 of the packaging blank 41 exactly on target, which additionally reduces the risk of a crack in the packaging blank 41 occurring during the pressing of the beverage containers 2 into the openings 42. The shape of the side partitions 43 tapering in the opposite direction to the carrier 34 has also proved to be effective in preventing damage to the beverage containers 2 during contact with the side partitions 43 and in preventing the beverage containers 2 from tilting during pushing.

In order to be able to remove a packaging blank 41 from a magazine 48 or from dies 18 (cf. FIG. 11), to be able to move the packaging blank 41 then removed in the direction of the groupings 3 and to be able to hold the respective packaging blank 41 moved in the direction of the groupings 3 firmly on the gripper head 26 until it is applied to a respective grouping 3, the gripper head 26 comprises several suction instruments 39. The suction instruments 39 can each be subjected to negative pressure or can fix flat packaging blanks 41 to the working tool 15 via negative pressure. For this purpose, the working tool 15 comprises several suction instruments 39 for each flat packaging blank 41 to be accepted, so that the respective flat packaging blank 41 can be held securely on the working tool 15 via the respective several suction instruments 39.

In FIG. 5 the suction instruments 39 are shown enlarged again. FIG. 5 also shows a further enlargement of the support 34 and the support plate 35, to which the manipulation elements 37, the side partitions 43 and the rear wall 46 are suspended.

From the perspective view shown in FIG. 6, which shows the application head 26 from below, it can be seen that the lateral partitions 43 are oriented parallel to each other. On the right-hand side, FIG. 6 shows a packaging blank 41, which is held by the application head 26 between two side partitions 43. For each beverage container 2, the packaging blank 41 already forms a respective opening 42 into which the respective beverage container 2 can be inserted or pressed. To illustrate, FIG. 6 already shows a beverage container 2 which has been pressed into an opening 42 of the packaging blank 41 via the application head 26 and is now fixed to the packaging blank 41.

With the design shown in the figures of the present patent application, the packaging blank 41, when applied to a respective grouping 3, already forms an assigned opening 42 for each beverage container 2 2 of the respective grouping 3. In further embodiments, however, it is also possible that an area in packaging blank 41 intended to form the openings 42 is pre-punched and that the openings 42 are only formed when packaging blank 41 is applied to the beverage containers 2. The beverage containers 2 can be guided against the pre-punched area under the action of force, the pre-punched area being at least partially separated from the packaging blank 41 and openings 42 thereby being formed in the flat packaging blank 41. Such designs of a packaging blank 41 can also be applied to several beverage containers 2 by the design of an application head 26 as shown in FIGS. 4 to 6.

FIG. 7 shows an example of a manipulation element 37. The manipulation element 37 is part of the design type application head 26 according to FIGS. 4 to 6, but can be used in a general context independently of this design type or, if necessary, be part of other design types. The manipulation element 37 comprises a contact surface 38 which is brought into surface contact with the packaging blank 41 for pressing a beverage container 2 into an associated opening 42 under the application of force. The contact surface 38 has a curved shape. From an overview of FIGS. 7 and 8, it is clear that the contact surface 38 of the manipulation element 37 does not lie completely or only in areas against the packaging blank 41 immediately upon impact with the packaging blank 41. If the manipulation element 37 is moved further in the direction of the beverage container 2 starting from its position according to FIG. 8, the contact surface 38 of the manipulation element 37 comes into contact with the packaging blank 41 at a certain point in time along the entire circumferential course of the respective opening 42 formed in the packaging blank 41 due to elastic deformation of the packaging blank 41 and then presses the beverage container 2 through the opening 42 until the beverage container 2 is firmly held on the packaging blank 41. Due to the curved shape of the contact surface 38, a force required to press a respective beverage container 2 into a respective opening 42 is applied to the packaging blank 41 with a time offset along the circumferential course of the opening 42. Thus, when a beverage container 2 begins to be pressed into a respective opening 42, the manipulation element 37 first comes into surface contact with the packaging blank 41 at several areas offset along the circumferential course of the respective opening 42. It is only during the further pressing of the respective beverage container 2 into the respective opening 42 that an area with which the manipulation element 37 comes into contact with the packaging blank 41 via the contact surface 38 is increased in area, whereby the risk of unintentional tearing of the packaging blank 41 in the area of the respective opening 42 can be kept very low. Apart from the curved course of the contact surface 38, there are further designs for forming the contact surface 38 of the manipulation element 37, with which the force required to press a respective beverage container into a respective opening 42 can be applied to the packaging blank 41 along the circumferential course of the respective opening 42 with a time delay. For example, the contact surface 38 can be designed in a straight line and set at an angle to the packaging blank 41. Other designs have also proved successful in which the manipulation elements 37, which are designed as part of an application head 26, are rotated for the staggered application of a force intended to press a particular beverage container 2 into a particular opening 42. An axis of rotation can run along a longitudinal axis of the respective beverage container 2. The shape of the contact surface 38 of the respective manipulation element 37 can still have a curved course or be set at an angle to the packaging blank 41.

In FIG. 9, individual aspects of the illustration in FIG. 8 are again shown in detail or enlarged. The curved or curvilinear course of the contact surface 38 of the manipulation element 37 can still be seen. FIG. 7 also shows that the packaging blank 41 has several retaining tabs 49 in the area of a respective opening 42. A respective beverage container 2 also forms an upper edge 51 or seam (see FIG. 10), which runs around a closure of a respective beverage container 2 designed as a beverage can.

After a respective beverage container 2 has been pressed into a respective opening 42, the retaining tabs 49 are each arranged below the respective upper edge 51 and fix the packaging blank 41 immovably in the axial direction to the respective beverage container 2, which is designed as a beverage can. In order to keep the force required to press the beverage containers 2 into the openings 42 to a minimum, designs have proved effective in which the retaining tabs 49 are pre-bent before the beverage containers 2 are pressed into the openings 42 or, if necessary, converted to an upright orientation as shown in FIG. 8. For this purpose, apparatus 1 can comprise several dies 18 as described below.

FIG. 10 shows a schematic view of a multipack 4, which can be produced from different embodiments of the apparatus 1 according to the invention and with different embodiments of the method 100 according to the invention. The multipack 4 according to the embodiment shown in FIG. 4 comprises eight beverage containers 2, each of which is designed as a beverage can, as well as a packaging blank 41, by which packaging blank 41 the beverage containers 2 are held together. The packaging blank 41 can, for example, be made of plastic material or cellulose-containing materials.

FIG. 10 shows that the packaging blank 41 is designed with a respective opening 42 for each beverage container 2, through which opening 42 the respective beverage container 2 passes with an upper section. In order to apply the packaging blank 41 to the beverage containers 2, the packaging blank 41 is pressed onto the beverage containers 2 with a defined force in the direction from above; thereby the beverage containers 2 pass through the openings 42 with their upper section. FIG. 4 furthermore illustrates, that the beverage containers 2 must be aligned with respect to one another, so that the upper part of the beverage containers 2 can pass through the respectively assigned openings 42 of the packaging blank 41 when the packaging blank 41 is applied.

The alignment of the beverage containers 2 with respect to one another is such that the beverage containers 2 along their respective longitudinal direction are in alignment with the respective assigned opening 42 of the packaging blank 41. After having applied the packaging blank 41 to the beverage containers 2 according to FIG. 4, the beverage containers 2 are held together by the packaging blank 4 in a form-fitting and force-fitting manner. It is conceivable, that the beverage containers 2 of the multipack 4 are held together via further connection elements, which are not shown in FIG. 4. In particular, an adhesive joint may be formed between lateral surface areas of immediately adjoining beverage containers 2.

Figure 14:
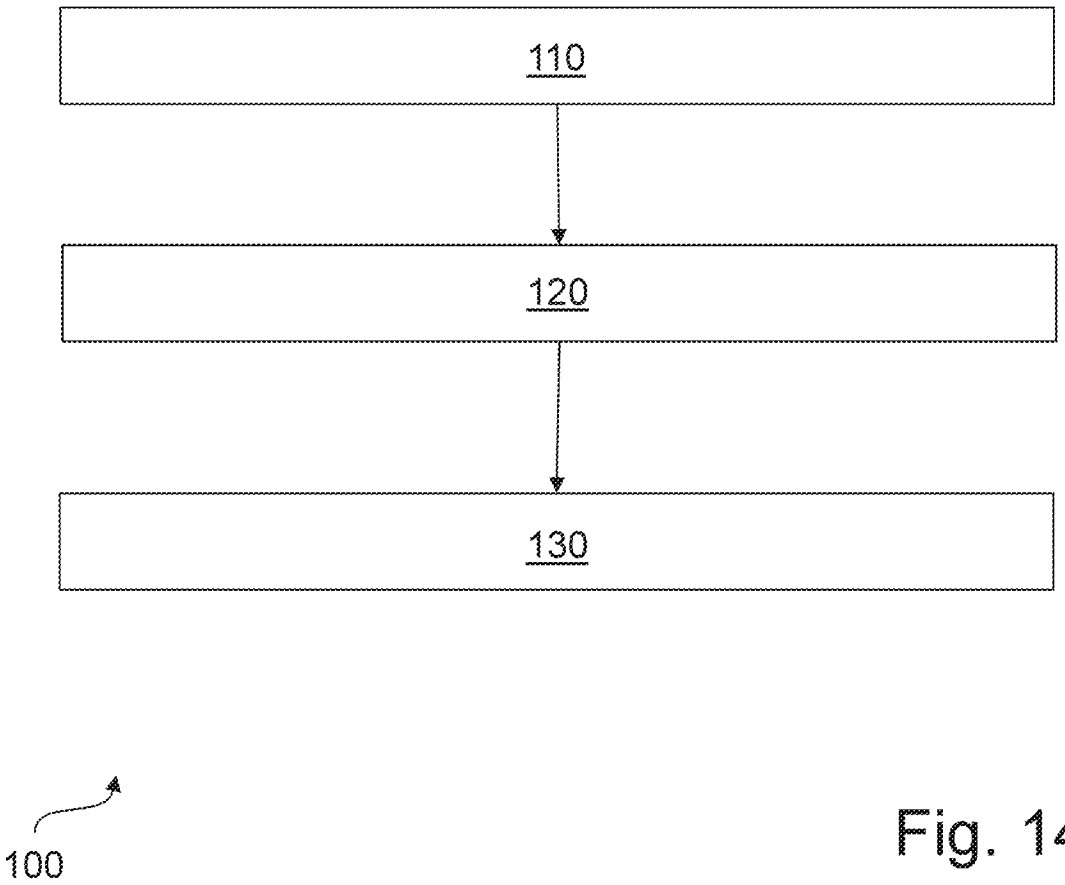
FIG. 14 shows, in a flowchart, individual steps, which steps may be provided for in various embodiments of the method according to the invention.

FIG. 11 shows a schematic perspective view of a further embodiment of the apparatus 1 according to the invention and illustrates individual steps as they may be provided for in various embodiments of the procedure 100 according to the invention (see FIG. 14). The apparatus 1 comprises a staging 72 which transports beverage containers 2 in several parallel rows. For transport in several parallel rows, the feeder 72 has several guide rails 21, whereby a single-row beverage container flow is moved between directly adjacent guide rails 21.

The design according to FIG. 11 also includes a horizontal conveyor 5, which moves beverage containers 2 set down on it in conveying direction FR. The conveying direction FR and the direction of movement, by which the staging unit transports 72 beverage containers 2 in several parallel rows, are oriented parallel to each other.

Furthermore, the apparatus 1 comprises a handling device 15 with several gripper heads 17, by which the handling device 15 can receive beverage containers 2 which have been moved up to that point in several parallel rows via the staging 72 and deposit them on the horizontal conveyor 5 as a grouping 3. The apparatus 1 according to FIG. 11 also provides that the beverage containers 2 of a respective grouping 3 have an alignment to one another that is provided for the application of the respective packaging blank 41 or is suitable for this purpose immediately when they are set down on the horizontal conveyor 5.

Furthermore, apparatus 1 includes a magazine 48, which picks up the packaging blanks 41 not yet applied to grouping 3. For this purpose the magazine 48 comprises several tines 19, whereby a respective tine 19 grips through a respective opening 42 of a respective packaging blank 41 picked up in the magazine 48. The packaging blanks 41 are thus held in magazine 48 by the tines 19.

In practice, it may be that the gripper heads 26 have to apply a relatively high force to apply a respective packaging blank 41 to a respective grouping 3. Taking Multipack 4 from FIG. 10 into account, it can be seen here that an upper edge 51 of a respective beverage container 2 designed as a beverage can must be inserted through a respective opening 42 if a respective packaging blank 41 is to be applied to a respective grouping 3. Since the packaging blank 41 must be elastically deformed in this process, it is possible that individual or several of the beverage containers 2 will inadvertently tip over when the packaging blank 41 is applied to a respective grouping 3. In order to reduce the resistance of the packaging blanks 41 in the area of the openings 42, the packaging blanks 41 are first placed on dies 18 in the apparatus according to FIG. 11, with a respective die 18 dipping into a respective opening 42 of a respective packaging blank 41. It is possible for the gripper heads 26 to remove a respective packaging blank 41 from the magazine 48, followed in time by the dies 18 plunging into the openings 42 of the respective packaging blank 41 and then using the dies 18 to elastically deform or stretch a respective edge region of a respective opening 42, so that the resistance force to be overcome to apply the packaging blank 41 to a respective grouping 3 is reduced. In the case of design form 1 according to FIG. 11, however, it is intended that a transfer tool 90, shown in detail in FIG. 12, takes a respective packaging blank 41 from the magazine 48 and then places it on the dies 18 so that a respective die 18 is immersed in a respective opening 42 of a respective packaging blank 41. The transfer tool 90 then leaves a close range of the dies 18 and is moved back towards the magazine 48. Superimposed on the movement of the transfer tool 90 in the direction of the magazine 48, the gripper heads 26 are moved in the direction of the packaging blanks 41 placed on the dies 18 and then come into contact with the packaging blanks 41 that are still resting on the dies 18. The packaging blanks 41 are then pressed down onto the matrices 18 via the application heads 26 in the direction of the matrices 18, whereby the edges of the openings 42 are stretched. Subsequently, the application heads 26 remove the packaging blanks 41 from the dies 18, move the packaging blanks 41 removed from the dies 18 in the direction of the groupings 3 arranged on the horizontal conveyor 5 and then apply the packaging blanks 41 to the groupings 3. Since the edge areas of the openings 42 were previously stretched by the dies 18, a resistance force which must be overcome in order to apply the packaging blanks 41 to groupings 3 is reduced in comparison with designs without a previous such stretching of the edge areas.

As already mentioned above, the packaging blanks 41 are placed on the dies 18 by a transfer tool 90, whereby a respective die 18 dips into a respective opening 42 of a respective packaging blank 41. The number of dies 18 must therefore be at least equal to the number of openings 42 formed by the packaging blanks 41. In order to enable the dies 18 to dip into the openings 42, the arrangement or position of the dies 18 must also be matched to the respective arrangement or position of the openings 42 which form the packaging blanks 41. In order to produce different Multipacks 4, it is possible that packaging blanks 41 may be required for this purpose, which differ with regard to the respective number of openings 42 and/or their respective position or arrangement in packaging blank 41. It may therefore be necessary to exchange the dies 18 if different multipacks 4 are to be produced in consecutive packaging processes using apparatus 1.

In order to be able to exchange dies 18 quickly and easily, several dies 18 are combined to form a respective format part in the design shown in FIG. 11. If packaging blanks 41 are changed on the apparatus 1, which differ in terms of the number and/or arrangement of the openings 42, format parts are exchanged, which format parts each comprise several dies 18. The exchange of format parts comprising several matrices 18 can be carried out by a user or an industrial robot, for example. There are also designs in which format parts comprising several dies 18 can be exchanged by a driverless transport system if necessary.

Figure 12:
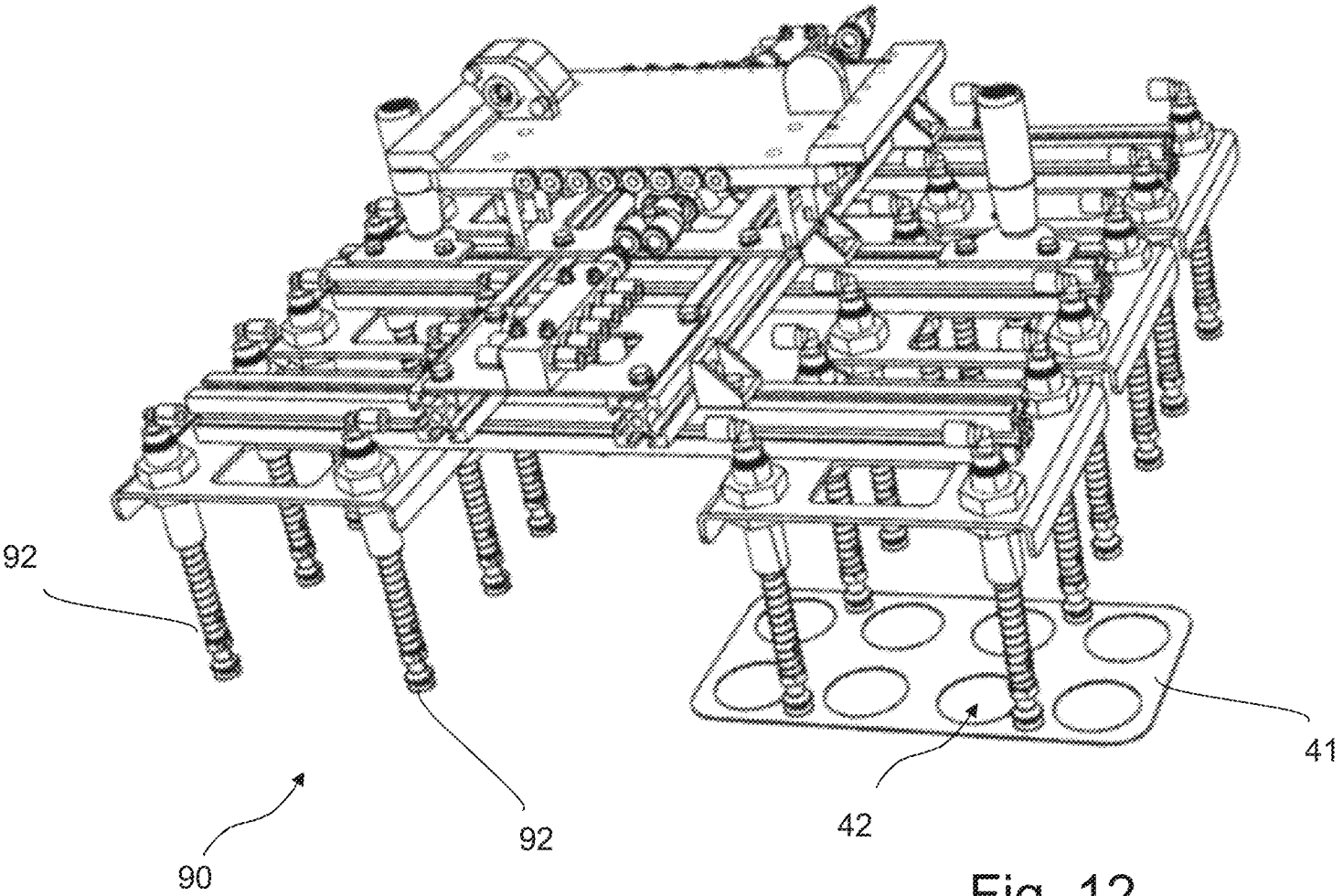
FIGS. 12 and 13 show individual details of the design of the apparatus according to FIG. 11.
Figure 13:
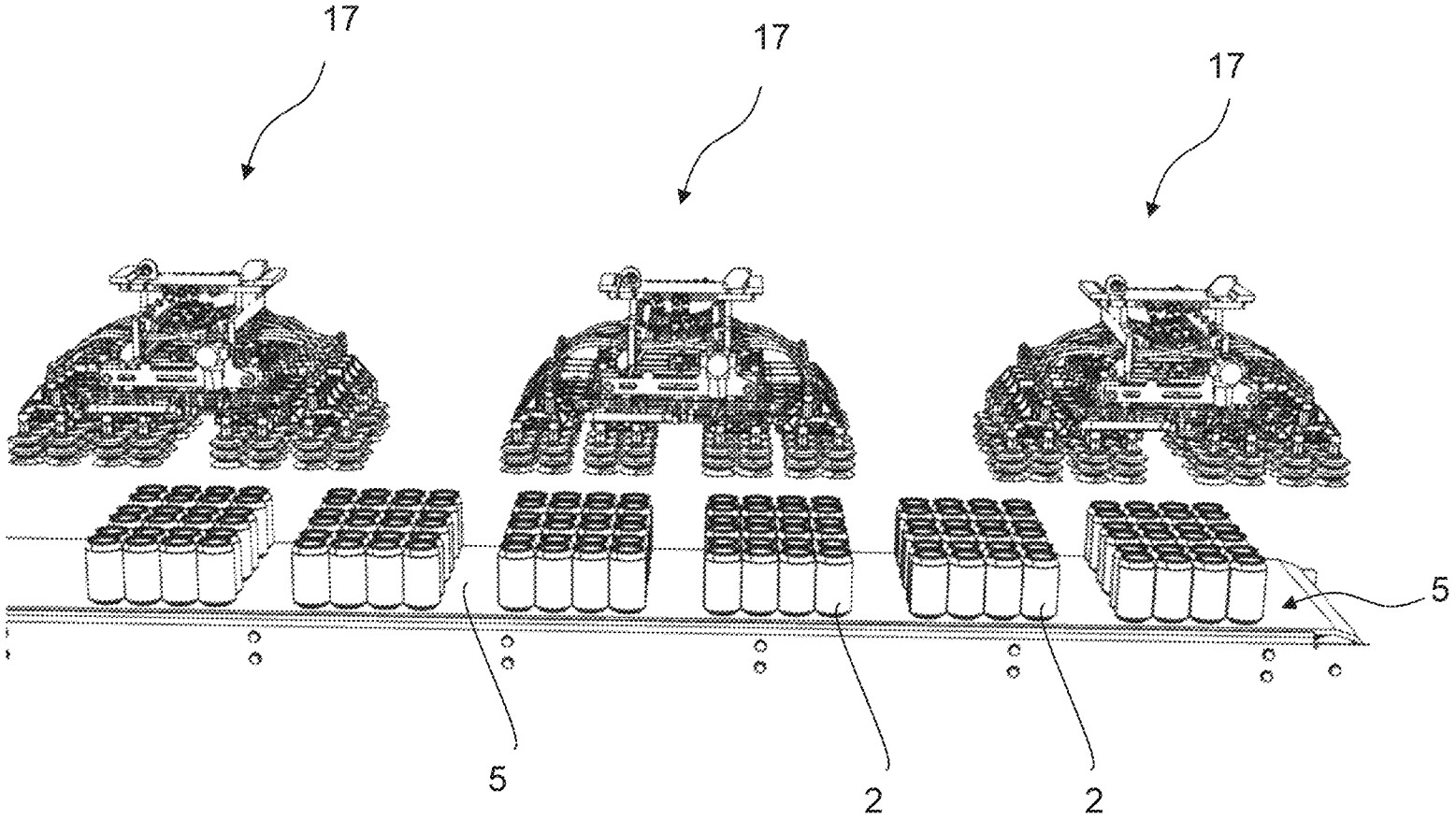

FIGS. 12 and 13 show individual details of the design of a apparatus 1 according to FIG. 11. FIG. 12 shows the previously mentioned transfer tool 90, which can take packaging blanks 41 from a magazine 48 and place them on the dies 48. For each packaging blank 41, the transfer tool 90 has four assigned supporting tappets 92, which are each spring-mounted and can pneumatically grip a respective packaging blank 41.

FIG. 13 shows in particular once again the gripper heads 17 already shown in FIG. 11, which pick up beverage containers 2 from a supply unit 72 (cf. FIG. 11) and place them as grouping 3 on the horizontal conveyor 5. The beverage containers 2 of each grouping 3 are already aligned with each other immediately when they are set down on the horizontal conveyor 5 so that the respective packaging blank 41 can be applied.

FIG. 14 shows, in a flowchart, individual steps, which steps may be provided for in various embodiments of the method 100 according to the invention. The method 100 according to the embodiment shown in FIG. 14 can be implemented by an apparatus 1 according to a previously described embodiment shown in FIGS. 1 to 3 or in FIG. 11.

In the context of a first step of the method 100, which is referred to by reference number 110, several groupings 3, each comprising several beverage containers 2, are deposited or placed on a horizontal conveying device 5 by a handling apparatus 15, which handling apparatus 15 is coming from above. Deposition or placement takes place by the handling apparatus 15 in such a way, that the several beverage containers 2 of a respective grouping 3 are aligned with respect to one another for the application of a respective packaging blank 41 immediately upon placement on the horizontal conveying device 5.

Method step 110 is temporally followed by method step 120, in which the groupings 3 with the beverage containers 2, which are arranged in an alignment with respect to one another, are moved via a horizontal conveying device 5 in the direction of a working device 25. During the movement of the groupings 3 with beverage containers 2, which beverage containers 2 are already arranged in an alignment with respect to one another, in the direction of the working device 25, the beverage containers 2 of the groupings 3 are at no time in contact with any guiding elements extending along a conveying direction FR of the horizontal conveying device 5 or retaining elements, which guiding elements or retaining elements are designed for contacting lateral surface areas of beverage containers 2. During the movement of the groupings 3 over the horizontal conveying device 5 directly adjacent beverage containers 2, which are arranged in an alignment with respect to one another for the application of the packaging blank 4, may be in surface contact with one another via their lateral surface areas. In addition to this surface contact, the beverage containers 2 of each grouping 3, which beverage containers 2 are arranged in an alignment with respect to one another, only have one further contact with the horizontal conveying device 5. Therefore, for the implementation of the method 100 no guiding elements are required to be arranged along a conveying direction FR (see FIGS. 1 to 3) of the horizontal conveying device 5. Also no retaining elements moving along with the groupings, as known from generic prior art apparatuses, are necessary or provided in apparatus 1 according to the invention.

Temporally, after a respective grouping 3 with its beverage containers 2 has entered the working area of the working device 25 (see FIGS. 2 and 3), whereby the beverage containers 2 of the grouping are still arranged in alignment with respect to one another up to that point, method step 130 is carried out. In the method step 130, a respective packaging blank 41 is applied to a respective grouping 3 in such a way, that the respective beverage containers 2 of the respective grouping 3 are held together form-fittingly and force-fittingly by the respective packaging blank 41. The application of packaging blanks 41 to groupings 3 can be carried out according to the previous description regarding FIG. 2 or FIG. 3. During the entire movement of the groupings 3 into the working area of the working device 25 and during the application of the packaging blanks 41 onto the groupings 3, the beverage containers 2 of a respective grouping 3, which beverage containers 2 are arranged in alignment with respect to one another, are at no time in contact with (any) guiding rails extending along the conveying direction FR. Also, the beverage containers 2 of a respective grouping 3, which beverage containers 2 are arranged in alignment with respect to one another, do not at any time during the entire movement into the working area of the working device 25 and during the application of packaging blanks 41 contact any retaining elements with their lateral surface areas.

The invention has been described with reference to preferred embodiments. To the expert it is also conceivable, however, to make changes and modifications without leaving the scope of protection of the appended claims.

LIST OF REFERENCE NUMBERS

1 apparatus
2 beverage container
3 grouping
4 multipack
5 horizontal conveying device
10 first module
15 handling device
17 gripping head
19 tine
20 second module
25 working device
26 application head
34 carrier
35 carrier plate
37 manipulation element
38 contact surface
39 suction instrument
41 packaging blank
42 Opening
43 Side partition
46 Rear wall
48 Magazine
49 Retaining tab
51 Upper edge
72 Supply unit
90 Transfer tool
92 Supporting tappet
100 method
110 first method step
120 second method step
130 third method step
FR conveying direction
S control and/or regulating device

The invention claimed is:

1. A method (100) for producing a multipack (4) having a plurality of beverage containers (2), comprising:

placing a plurality of groupings (3), each comprising a plurality of beverage containers (2), on a horizontal conveying device (5) with at least one handling apparatus (15), wherein the plurality of beverage containers (2) are aligned with respect to one another upon placement of the beverage containers (2) on the horizontal conveying device (5) and are ready to have a packaging blank (41) applied to each of the plurality of groupings (3)

applying a packaging blank (41) to the plurality of aligned beverage containers (2) of a grouping (3) such that the plurality of aligned beverage containers (2) pass through one or more openings (42) of the packaging blank (41), and the plurality of aligned beverage containers (2) are subsequently held together by the packaging blank (41), wherein the applying step comprises moving the plurality of aligned beverage containers (2) on a horizontal conveying device (5) without lateral surface areas of the plurality of aligned beverage containers (2) bearing against any retaining element or guiding element.

2. The method of claim 1, further comprising moving the plurality of aligned beverage containers (2) without interruption via the horizontal conveying apparatus (5) during the applying step.

3. The method of claim 2, further comprising applying a packaging blank (41) to a grouping (3) via at least one application head (26), wherein the at least one application head (26) performs a lowering movement toward the groupings (3).

4. The method of claim 3, further comprising picking up at least one packaging blank (41), with the application head (26), from a stack, wherein the stack is positioned laterally beside the horizontal conveying device (5) and comprises a plurality of packaging blanks (41), then positioning the at least one packaging blank (41) above at least one grouping (3), and then executing the lowering movement.

5. The method of claim 4, wherein, after executing the lowering movement, applying a plurality of packaging blanks (41) to a plurality of different groupings (3).

6. The method of claim 5, further comprising applying a plurality of packaging blanks (41) to a plurality of different groupings (3) with a time delay.

7. The method of claim 6, wherein the at least one application head (26) comprises at least one centering device, wherein the centering device restores an alignment of the plurality of beverage containers (2) of a grouping (3) with respect to one another.

8. The method of claim 7, wherein the beverage containers (2) are cans.

9. The method of claim 2, further comprising moving the aligned beverage containers (2) at an at least approximately constant transport speed.

10. An apparatus (1) for producing a multipack (4) having a plurality of beverage containers (2), comprising:

a horizontal conveying device (5) for moving groupings (3), each grouping (3) comprising a plurality of beverage containers (2);

at least one working device (25), wherein the at least one working device (25) applies a packaging blank (41) to a grouping (3), so that the beverage containers (2) of a grouping (3) pass through openings (42) of the packaging blank (41) and are held together via the packaging blank (41);

at least one handling apparatus (15) for placing the beverage containers (2) of a grouping (3) on the horizontal conveying device (5) wherein the beverage containers (2) of a grouping (3) are aligned with respect to one another upon placement of the beverage containers (2) on the horizontal conveying device (5) and are ready to have a packaging blank (41) applied to each of the plurality of groupings (3), wherein the groupings (3) are continuously moved via the horizontal conveying device (5) without surface contact of lateral surface areas of the beverage containers (2) to any retaining elements or guiding elements.

11. The apparatus (1) of claim 10, wherein the at least one handling apparatus (15) is formed by or comprises at least one multi-axis robot.

12. The apparatus (1) of claim 11, further comprising a control or regulating device (S) connected to the horizontal conveying device (5).

13. The apparatus (1) of claim 12, wherein the working device (25) comprises at least one application head (26), wherein the at least one application head (26) can execute a lowering movement toward groupings (3) for applying packaging blanks (41) to the groupings (3).

14. The apparatus (1) of claim 13, wherein the at least one application head (26) is movable back and forth between the horizontal conveying device (5) and a stack of packaging blanks (41) positioned laterally beside the horizontal conveying device (5).

15. The apparatus (1) of claim 14, wherein the at least one application head (26) can apply a plurality of packaging blanks (41) to a plurality of groupings (3) with a time delay after the lowering movement.

16. The apparatus (1) of claim 15, wherein the at least one application head (26) comprises at least one centering device, wherein the centering device restores an alignment of the plurality of beverage containers (2) of a grouping (3) with respect to one another.

17. The apparatus (1) of claim 16, wherein the plurality of beverage containers (2) are cans.

* * * * *